US012398976B2

(12) United States Patent
Nguyen

(10) Patent No.: US 12,398,976 B2
(45) Date of Patent: Aug. 26, 2025

(54) REAR SIGHT AND RELATED ASSEMBLY

(71) Applicant: Tu Nguyen, Escondido, CA (US)

(72) Inventor: Tu Nguyen, Escondido, CA (US)

( * ) Notice: Subject to any disclaimer, the term of this patent is extended or adjusted under 35 U.S.C. 154(b) by 49 days.

(21) Appl. No.: 18/495,000

(22) Filed: Oct. 26, 2023

(65) Prior Publication Data

US 2024/0142200 A1 May 2, 2024

Related U.S. Application Data

(60) Provisional application No. 63/438,698, filed on Jan. 12, 2023, provisional application No. 63/422,536, filed on Nov. 4, 2022, provisional application No. 63/420,294, filed on Oct. 28, 2022.

(51) Int. Cl.
*F41G 1/10* (2006.01)

(52) U.S. Cl.
CPC ..... *F41G 1/10* (2013.01)

(58) Field of Classification Search
CPC ..... F41G 1/10
See application file for complete search history.

(56) References Cited

PUBLICATIONS

Parker Mountain:??www.thefirearmblog.com/blog/2021/03/31/pmm-integrated-rear-sight/.*
Third party submission (Year: 2024).*
Internet document (Year: 2021).*

* cited by examiner

*Primary Examiner* — J. Woodrow Eldred
(74) *Attorney, Agent, or Firm* — CP LAW GROUP PC; Cy Bates

(57) ABSTRACT

A rear sight and related assembly are disclosed. The rear sight has a notch component coupled to a base portion. The notch component includes a notch forming a channel through the notch component, the channel having a channel direction. The base portion has a first flange having a first aperture and a second flange having a second aperture couple coupling with an optic mount. The assembly of the rear sight includes the rear sight coupled to the optic mount. The apertures of the rear sight are configured to concentrically align with mounting holes of the optic mount. The optic mount is configured to couple to a slide of a firearm.

20 Claims, 23 Drawing Sheets

REAR SIGHT AND RELATED ASSEMBLY

CROSS-REFERENCE TO RELATED APPLICATIONS

This application claims benefit of priority with U.S. Provisional Application Ser. Nos. 63/420,294, filed Oct. 28, 2022, Ser. No. 63/422,526 filed Nov. 4, 2022, and Ser. No. 63/438,698 filed Jan. 12, 2023; the entire contents of which are hereby incorporated by reference.

BACKGROUND

Field of the Invention

This disclosure relates to a firearm accessory, and more particularly to a rear sight configured to couple to an optic mount.

Description of the Related Art

Optic mounts are a common accessory added to firearms such as handguns. The optic mounts couple to a slide of the firearm and assist with aiming by providing a visual dot disposed on an optic sight. Many prefer the optic mount to be attached as far back on the slide to provide improved holster compatibility. However, conventional rear sights of iron sights typically manufactured with the firearm prevent the optic mount from being installed in such a position.

Current solutions include removing the rear sight from its conventional position and mount the rear sight in front of the optic mount such that the rear sight is disposed between the optic mount and a front sight of the firearm. This solution is suboptimal because it requires significant customization while also decreasing accuracy of the iron sight due to the rear and front sights being closer together. Another solution provided by optic mount manufacturers includes providing a rotatable rear sight coupled to an end of the optic mount. This solution causes the rear sight to extend off the slide and overhang the firearm which increases bulkiness and can get caught on clothing and holsters.

There is a need for an accessory that allows the optic mount to be installed to a back end of the slide while not decreasing accuracy or holster compatibility.

SUMMARY

A rear sight and related assembly are disclosed. The rear sight comprises a notch component coupled to a base portion. The notch component comprises a notch forming a channel through the notch component, the channel having a channel direction. The base portion comprises a first flange and a second flange. The first flange comprises a first aperture and the second flange comprises a second aperture.

The assembly of the rear sight comprises the rear sight coupled to an optic mount. The optic mount comprises a first mounting hole and a second mounting hole. The first aperture of the rear sight is configured to concentrically align with the first mounting hole. Additionally, the second aperture is configured to concentrically align with the second mounting hole. A first fastener is configured to couple to both the first aperture and the first mounting hole. A second fastener is configured to couple to both the second aperture and the second mounting hole. The optic mount is configured to couple to a slide of a firearm. In some embodiments, the first and second mounting holes are characterized as the mounting holes use to couple the optic mount to a slide of a firearm.

The rear sight and related assembly allow the optic mount to be positioned further back on the slide of the firearm while maximizing distance between the rear sight and a front sight of the firearm. The optic mount being positioned further back allows for better carrying and holster compatibility of the firearm. The optic mount is also further away from debris during discharge of the firearm. At the same time, the rear sight is spaced sufficiently apart from the front sight to increase accuracy. Additionally, bulk of the firearm is reduced.

BRIEF DESCRIPTION OF THE DRAWINGS

Other features, combinations, and embodiments will be appreciated by one having the ordinary level of skill in the art of firearms and accessories upon a thorough review of the following details and descriptions, particularly when reviewed in conjunction with the drawings, wherein.

DETAILED DESCRIPTION

Figure 1:
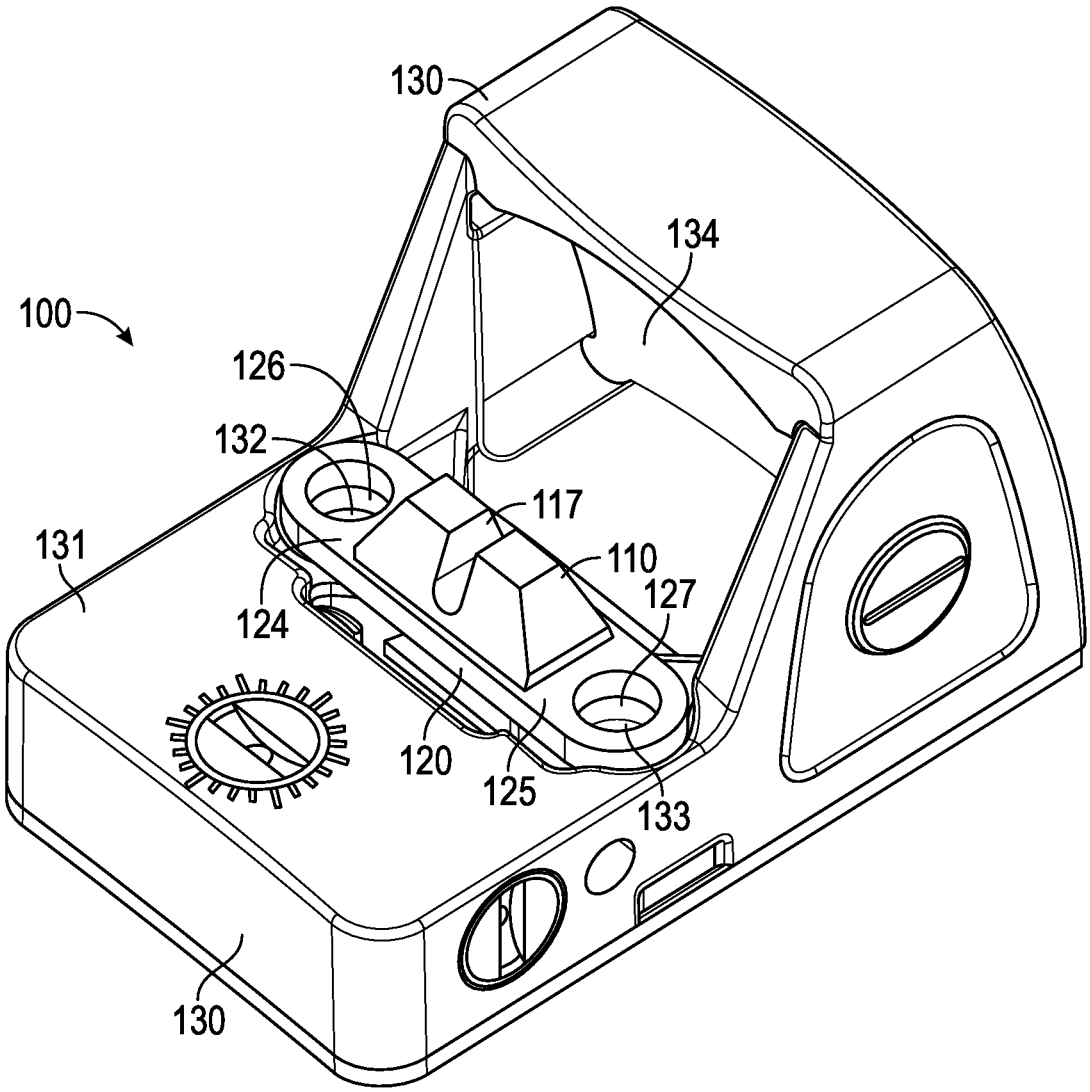
FIG. 1 shows a perspective view of the rear sight in accordance with a first illustrated embodiment.

For purposes of explanation and not limitation, details and descriptions of certain preferred embodiments are hereinafter provided such that one having ordinary skill in the art may be enabled to make and use the invention. These details and descriptions are representative only of certain preferred embodiments, however, a myriad of other embodiments which will not be expressly described will be readily understood by one having skill in the art upon a thorough review of the instant disclosure. Accordingly, any reviewer of the instant disclosure should interpret the scope of the invention only by the claims, as such scope is not intended to be limited by the embodiments described and illustrated herein.

For purposes herein, the term "optic mount" means a firearm accessory installed on a slide of the firearm. The optic mount assists a user with aiming to improve accuracy.

The term "support component" can be defined as any component used to raise the height of the notch component to a desirable level.

The term "flange" means a part or edge that sticks out from an object in order to keep the object in position or to attach it to another object.

The term "aperture direction" means direction of a fastener when disengaging from the aperture.

Unless explicitly defined herein, terms are to be construed in accordance with the plain and ordinary meaning as would be appreciated by one having skill in the art.

General Description of Embodiments

In one embodiment, a rear sight for a firearm is disclosed. The rear sight comprises a base portion having a top surface and a bottom surface opposite the top surface, the base portion further comprising a first flange and a second flange, the first flange comprises a first aperture and the second flange comprises a second aperture. The rear sight further comprises a notch component coupled to the base portion at the top surface, the notch component comprising a notch forming a channel, the channel having a channel direction.

In some embodiments, the first flange and the second flange may be disposed on opposite sides of the notch component.

In some embodiments, the first flange and the second flange may each extend in opposite directions from the base portion.

In some embodiments, the first aperture and the second aperture may each further comprise an aperture direction wherein the aperture direction of the each of the first aperture and the second aperture is orthogonal to the channel direction. In some embodiments, the aperture direction of the first aperture and the second aperture may be in a parallel configuration. In some embodiments the aperture direction of the first aperture and the second aperture may extend in opposite directions.

In some embodiments, the rear sight may further comprise a light opening wherein at least a portion of the light opening extends through the base portion. The light opening may be parallel to the channel direction.

In some embodiments, the notch component may further comprise a top side and a bottom side opposite the top side, the bottom side being coupled to the top surface of the base portion, wherein the notch component comprises a taper extending from the bottom side to the top side such that the top side comprises a smaller width than the bottom side.

In some embodiments, the base portion may comprise a uniform base thickness.

In some embodiments, the first aperture and the second aperture may be equidistant to the channel.

In some embodiments, the channel may be disposed centrally between the first aperture and the second aperture.

In some embodiments, the rear sight may further comprise a first countersunk extension coupled to the bottom surface and concentrically aligned with the first aperture, and a second countersunk extension coupled to the bottom surface and concentrically aligned with the second aperture. The rear sight may further comprise a first post element coupled to the first countersunk extension and a second post element coupled to the second countersunk extension. In some embodiments, the rear sight may further comprise a support component coupled to the bottom surface of the base portion, the support component disposed vertically below the notch component. The support component may be disposed between the first countersunk extension and the second countersunk extension. The rear sight may further comprise a light opening wherein at least a portion of the light opening extends through the support component.

In some embodiments, the notch component may further comprise an offset from the first flange and the second flange such that a gap is formed between the first flange and the second flange.

In some embodiments, the first flange and the second flange may each extend orthogonally from the base portion.

In some embodiments, the base portion may further comprise an elevated offset from each of the first flange and the second flange.

In some embodiments, the first flange and the second flange may each comprise a flange surface coplanar with the top surface of the base portion.

In some embodiments, the base portion may further comprise a front side and a back side opposite the front side, wherein a light opening extends from the back side into the base portion towards the front side thereby forming a recess.

In some embodiments, the first aperture and the second aperture may be threaded. In other embodiments, the first aperture and the second aperture may be unthreaded.

In some embodiments, the notch component may be integrally formed with the base portion. In other embodiments, the notch component and the base portion may comprise distinct components.

In another embodiment, a rear sight assembly for a firearm is disclosed. The rear assembly comprises a rear sight coupled to an optic mount. The optic mount comprises an optic body and an optic sight configured to receive a laser from an optic emitter, the optic mount further comprising a first mounting hole and a second mounting hole. The rear is coupled to the optic mount at the first mounting hole and the second mounting hole. The rear sight comprises a base portion having a top surface and a bottom surface opposite the top surface, the base portion further comprising a first flange and a second flange, the first flange comprises a first aperture and the second flange comprises a second aperture, and a notch component coupled to the base portion at the top surface, the notch component comprising a notch forming a channel, the channel having a channel direction.

In some embodiments, the assembly may further comprise a first fastener configured to couple to the first aperture and the first mounting hole, and a second aperture configured to couple to the second aperture and the second mounting hole.

In some embodiments, the notch component may be disposed vertically above the optic emitter In some embodiments, the first mounting hole and the second mounting hole may be disposed on the optic body. In some embodiments, the optic mount utilizes the first mounting hole and the second mounting hole for attachment to the firearm.

In some embodiments, the first mounting hole and the second mounting hole may be disposed on sides of the optic mount.

In some embodiments, the optic mount may further comprise a cutout feature between the optic emitter and the optic sight, wherein a support component is coupled to the bottom surface of the rear sight, the support component configured to be disposed in the cutout feature for elevating the notch component.

In some embodiments, the first aperture may concentrically align with the first mounting hole and the second aperture may concentrically align with the second mounting hole.

In some embodiments, the notch component may be disposed on the optic body and positioned above the optic emitter.

In some embodiments, the base portion may be disposed between the optic emitter and the optic sight.

In some embodiments, the first flange and the second flange may be disposed on opposite sides of the notch component.

In some embodiments, the first flange and the second flange may each extend in opposite directions from the base portion.

In some embodiments, the first aperture and the second aperture may each further comprise an aperture direction wherein the aperture direction of the each of the first aperture and the second aperture is orthogonal to the channel direction. In some embodiments, the aperture direction of the first aperture and the second aperture may be in a parallel configuration. In some embodiments the aperture direction of the first aperture and the second aperture may extend in opposite directions.

In some embodiments, the rear sight may further comprise a light opening wherein at least a portion of the light opening extends through the base portion. The light opening may be parallel to the channel direction.

In some embodiments, the notch component may further comprise a top side and a bottom side opposite the top side, the bottom side being coupled to the top surface of the base portion, wherein the notch component comprises a taper extending from the bottom side to the top side such that the top side comprises a smaller width than the bottom side.

In some embodiments, the base portion may comprise a uniform base thickness.

In some embodiments, the first aperture and the second aperture may be equidistant to the channel.

In some embodiments, the channel may be disposed centrally between the first aperture and the second aperture.

In some embodiments, the rear sight may further comprise a first countersunk extension coupled to the bottom surface and concentrically aligned with the first aperture, and a second countersunk extension coupled to the bottom surface and concentrically aligned with the second aperture. The rear sight may further comprise a first post element coupled to the first countersunk extension and a second post element coupled to the second countersunk extension. In some embodiments, the rear sight may further comprise a support component coupled to the bottom surface of the base portion, the support component disposed vertically below the notch component. The support component may be disposed between the first countersunk extension and the second countersunk extension. The rear sight may further comprise a light opening wherein at least a portion of the light opening extends through the support component.

In some embodiments, the notch component may further comprise an offset from the first flange and the second flange such that a gap is formed between the first flange and the second flange.

In some embodiments, the first flange and the second flange may each extend orthogonally from the base portion.

In some embodiments, the base portion may further comprise an elevated offset from each of the first flange and the second flange.

In some embodiments, the first flange and the second flange may each comprise a flange surface coplanar with the top surface of the base portion.

In some embodiments, the base portion may further comprise a front side and a back side opposite the front side, wherein a light opening extends from the back side into the base portion towards the front side thereby forming a recess.

In some embodiments, the first aperture and the second aperture may be threaded. In other embodiments, the first aperture and the second aperture may be unthreaded.

In some embodiments, the notch component may be integrally formed with the base portion. In other embodiments, the notch component and the base portion may comprise distinct components.

Manufacturing

The rear sight can be customized in accordance with the level and knowledge of one having skill in the art. The rear sight may be made of various materials including metal, polymer, and/or thermoplastics. Preferably, the rear sight comprises aluminum or steel.

Each of the components of the rear sight and related assembly described herein may be manufactured and/or assembled in accordance with the conventional knowledge and level of a person having skill in the art. In some embodiments, the rear sight is manufactured using die casting or CNC milling.

While various details, features, combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims.

First Illustrated Embodiment

Now turning to the drawings, FIG. 1 shows a perspective view of the rear sight (100) in accordance with a first illustrated embodiment. The rear sight comprises a notch component (110) extending from a base portion (120). The notch component comprises a notch (117) which is configured to align with a front sight of a firearm. The base portion comprises a first flange (124) and a second flange (125) disposed on opposite sides of the notch component. The first flange comprises a first aperture (126) extending through the base portion. The second flange comprises a second aperture (127) extending through the base portion.

The rear sight (100) is configured to couple to an optic mount (130). The optic mount comprises an optic body (131) having a first mounting hole (132) and a second mounting hole (133). The optic mount further comprises an optic sight (134) to assist a user. The first aperture (126) and the second aperture (127) of the rear sight are configured to align with the first mounting hole and the second mounting hole, respectively. The optic mount is configured to mount to a slide of a firearm. The rear sight is configured to be positioned between the optic sight and a user of the firearm. Additionally, the optic sight is configured to be positioned between the rear sight and a front sight of the firearm.

With the rear sight (100) coupled to the optic mount (130) as disclosed, the optic mount is capable of being disposed further back on the slide without having to position the rear sight either in front of the optic mount or overhanging the slide at the rear. Positioning the rear sight in front of the optic mount decreases the distance between the rear sight and the front sight, thereby decreasing accuracy. Overhanging the rear sight behind the optic mount and off the slide creates bulkiness which can catch onto clothes and holsters thereby making it susceptible to damage.

In some embodiments, the notch component (110) and base portion (120) are distinct components coupled together by welding, adhesive, or some other means as can be appreciated by one having skill in the art. Alternatively, the notch component can be integrally formed with the base portion such that the rear sight (100) is a single, monolithic.

Figure 2:
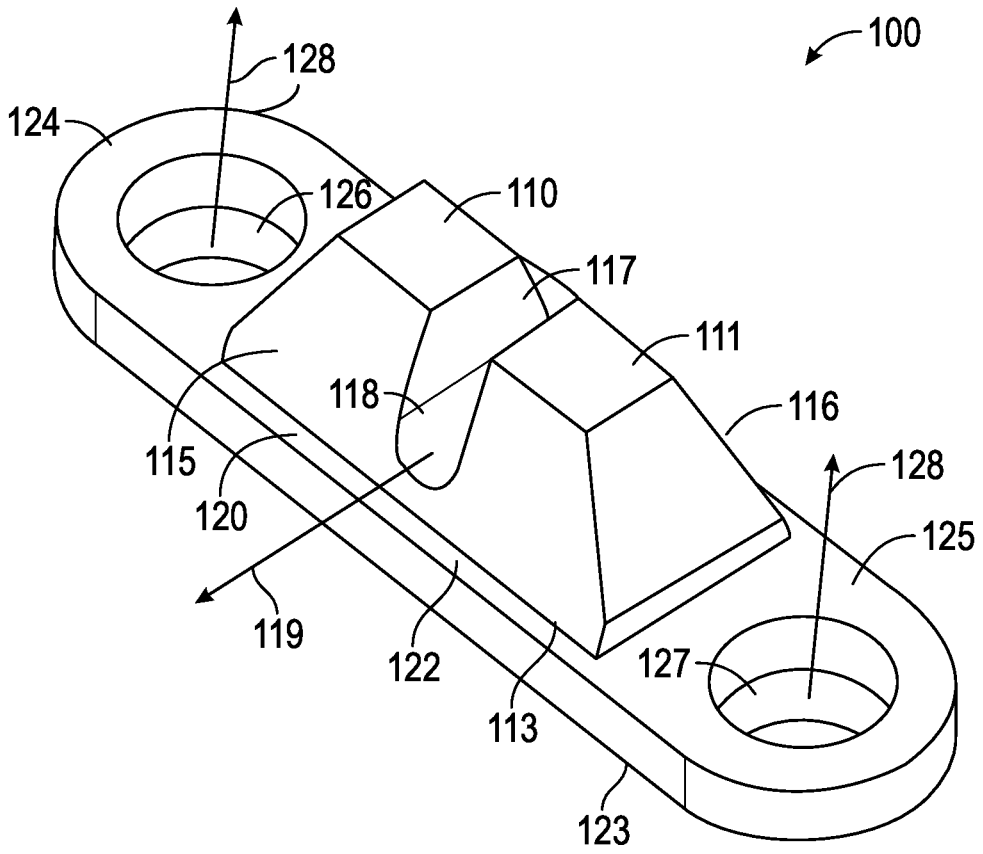
FIG. 2 shows a close-up view of the rear sight according to the first illustrated embodiment.

FIG. 2 shows a close-up view of the rear sight (100) according to the first illustrated embodiment. The rear sight includes a base portion (120) having a top surface (122) and a bottom surface (123) opposite the top surface. A first flange (124) is disposed near one end of the base portion, and a second flange (125) is disposed near an opposite end of the base portion. The first and second flanges comprise a first aperture (126) and a second aperture (127), respectively. Disposed between the first and second apertures is a notch component (110). The notch component comprises a top side (111), a bottom side (113) opposite the top side, a front side (115), and a back side (116) opposite the front side. The bottom side of the notch component is coupled to the top surface of the base portion. The notch component further comprises a notch (117) extending from the top side towards the bottom side. The notch creates a channel (118) extending from the front side to the back side.

Each of the first aperture (126) and second aperture (127) of the base portion (120) comprises an aperture direction (128) characterized as extending from the bottom surface (123) to the top surface (122). The channel (118) of the notch component (110) comprises a channel direction (119) characterized as extending from the back side (116) to the front side (115). As shown, the aperture direction is characterized as being orthogonal to the channel direction.

Figure 3:
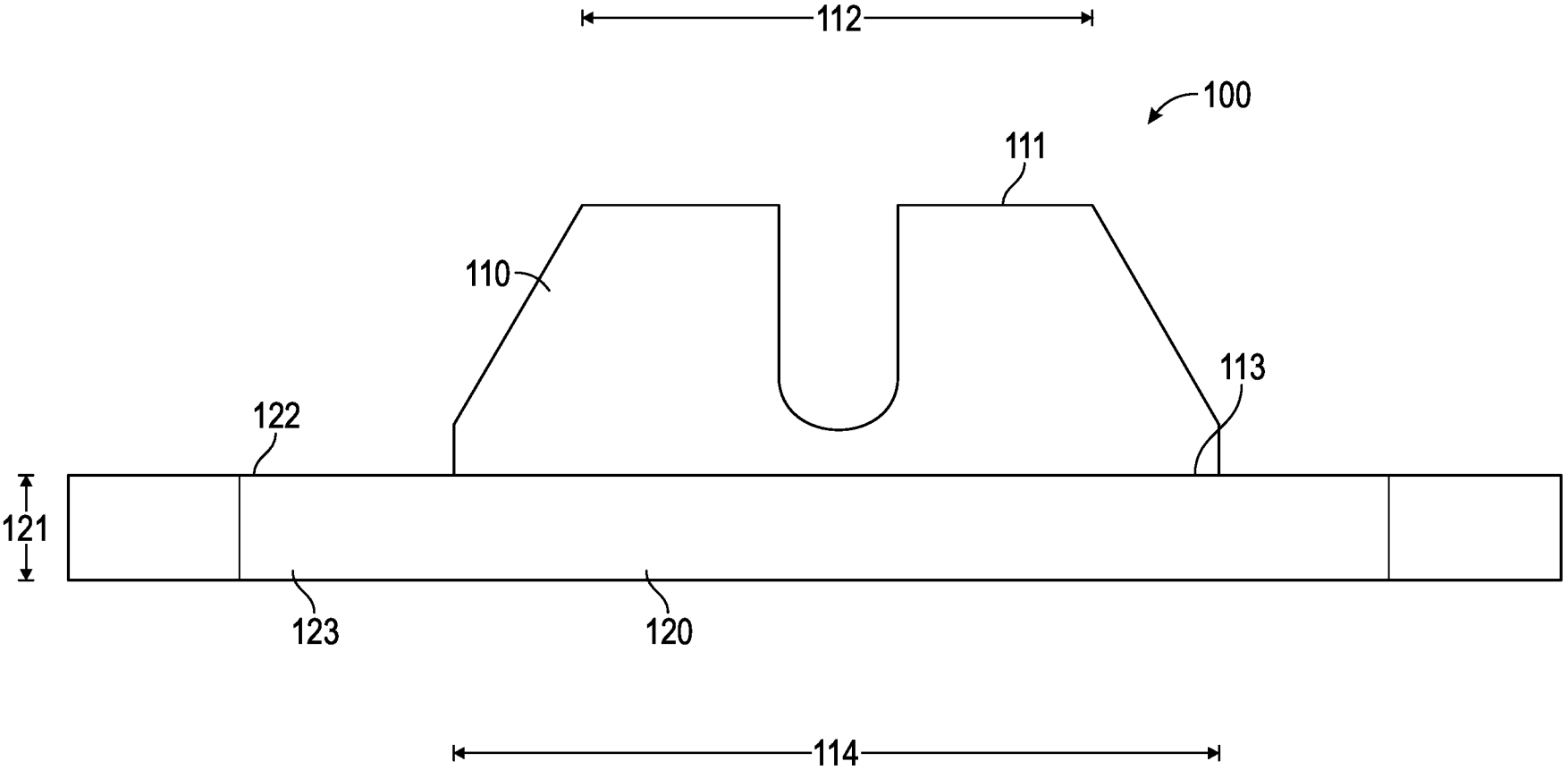
FIG. 3 shows a front view of the rear sight according to the first illustrated embodiment.

FIG. 3 shows a front view of the rear sight (100) according to the first illustrated embodiment. The rear sight includes a notch component (110) extending from a top surface (122) of a base portion (120). The notch component includes a top side (111) and a bottom side (113) opposite the top side. The top side comprises a top side width (112) and the bottom side comprises a bottom side width (114). The notch component comprises a taper extending from the bottom side towards the top side such that the top side width is less than the bottom side width. The base portion further comprises a base thickness (121) formed by the top surface and a bottom surface (123) opposite the top surface. The base portion comprises a uniform base thickness to provide proper leveling with an associated optic mount.

Figure 4:
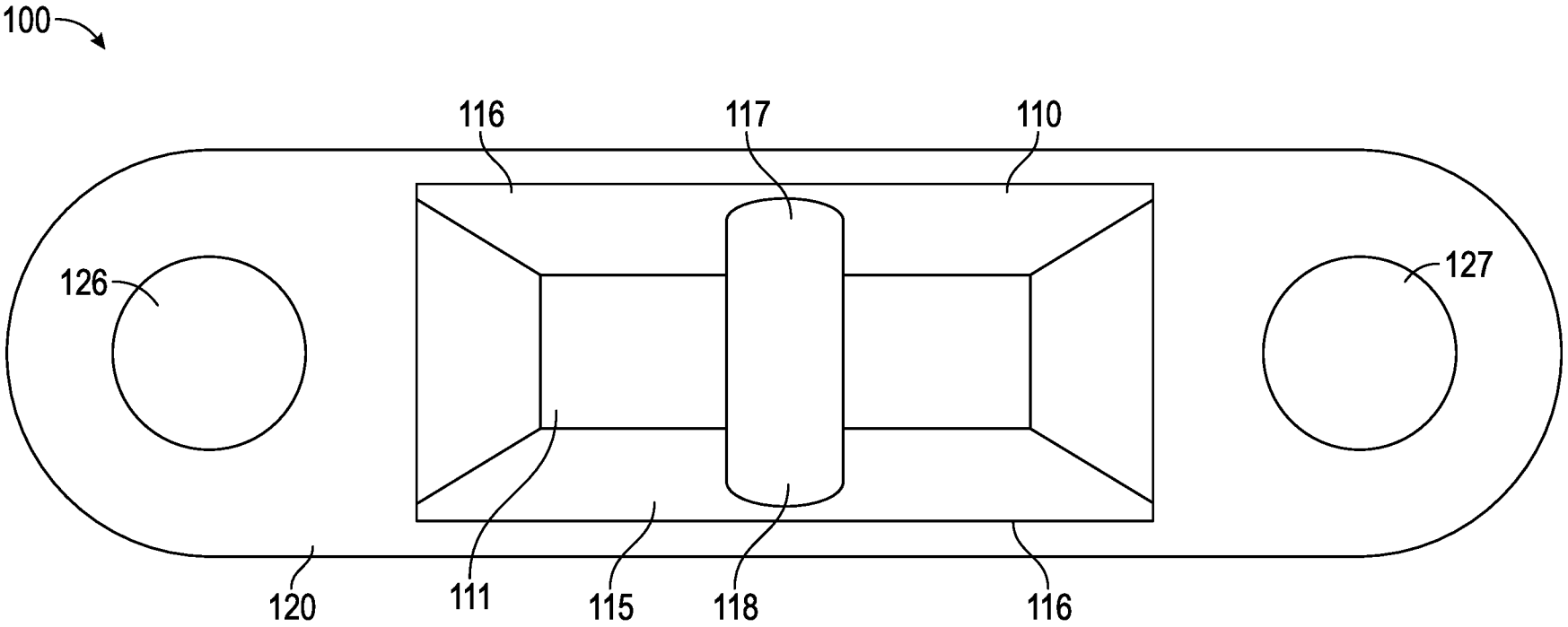
FIG. 4 shows a top view of the rear sight according to the first illustrated embodiment.

FIG. 4 shows a top view of the rear sight (100) according to the first illustrated embodiment. The rear sight includes a notch component (110) having a base portion (120) disposed below the notch component. The notch component includes a notch (117) extending from a top side (111) to towards a bottom side (113) of the notch component. The notch forms a channel (118) which extends through a front side (115) towards a back side (116) of the notch component. The base portion includes a first aperture (126) and a second aperture (127) disposed on opposite sides of the channel. In some embodiments, the first and second apertures are equidistant to the channel. Furthermore, the notch and associated channel of the notch component may be disposed centrally between the first and second apertures.

Second Illustrated Embodiment

Figure 5:
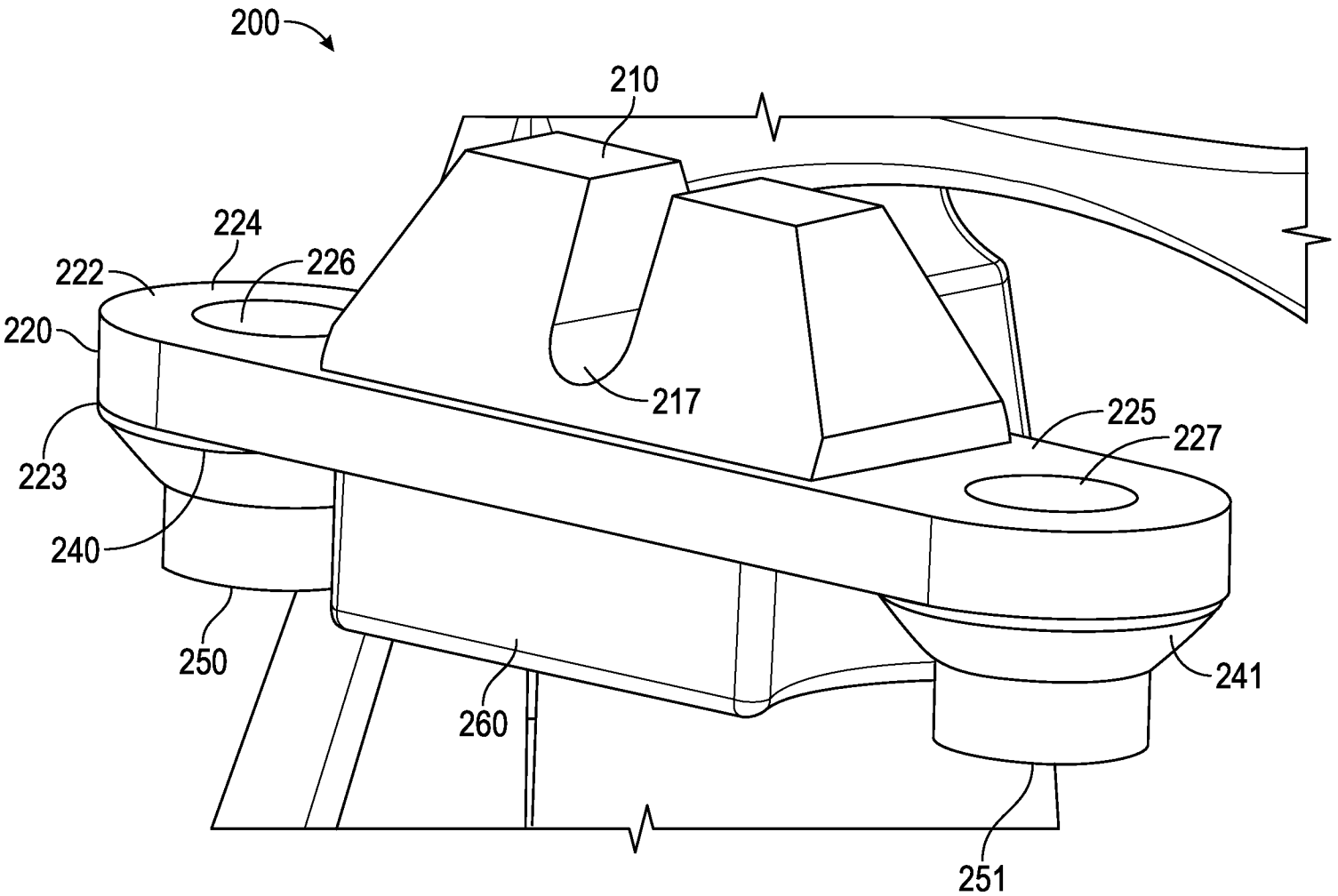
FIG. 5 shows a perspective view of the rear sight in accordance with a second illustrated embodiment.

FIG. 5 shows a perspective view of the rear sight (200) in accordance with a second illustrated embodiment. The rear sight comprises a notch component (210) coupled to a base portion (220) at a top surface (222) thereof. The base portion further comprises a first flange (224) and a second flange (225) each extending horizontally form the notch component. The first flange comprises a first aperture (226) extending from the top surface through a bottom surface (223) opposite the top surface. The second flange comprises a second aperture (227) extending from the top surface through the bottom surface. The notch component includes a notch (217) configured to be a rear sight of a firearm.

The rear sight (200) includes a first countersunk extension (240) coupled to the bottom surface (223) and concentrically aligned with the first aperture (226). A first post element (250) is coupled to the first countersunk extension and concentrically aligned with the first aperture such that the first countersunk extension is disposed between the bottom portion and the first post element. Additionally, a second countersunk extension (241) is coupled to the bottom surface and concentrically aligned with the second aperture (227). A second post element (251) is coupled to the second countersunk extension and concentrically aligned with the second aperture such that the second countersunk extension is disposed between the bottom portion and the second post element.

The first countersunk extension (240) and the second countersunk extension (241) are each configured to assist with alignment of the rear sight (200). The first and second countersunk extensions are configured to fit snugly within a first and second mounting hole of an optic mount, respectively. The first post element (250) and the second post element (251) are each configured to assist with alignment of the rear sight. The first and second post elements match a bore of the optic mount.

The rear sight (200) further comprises a support component (260) coupled to the bottom surface (223). The support component is disposed between the first countersink extension (240) and the second countersunk extension (241). Additionally, the support component is disposed vertically below the notch component (210) such that the base portion (220) is disposed between the notch component and the support component. The support component is configured to fit with optic mounts having a particular cut-out feature. The support component improves alignment of the rear sight with the optic mount.

In some embodiments, each component of the rear sight (200) may comprise distinct components and are coupled together by welding, adhesive, or other means as can be appreciated by one having skill in the art. In other embodiments, each of the components is integrally formed with each other such that the rear sight is a single, monolithic. Alternatively, some of the components of the rear sight may be integrally formed while other components are coupled by some other means.

Figure 6:
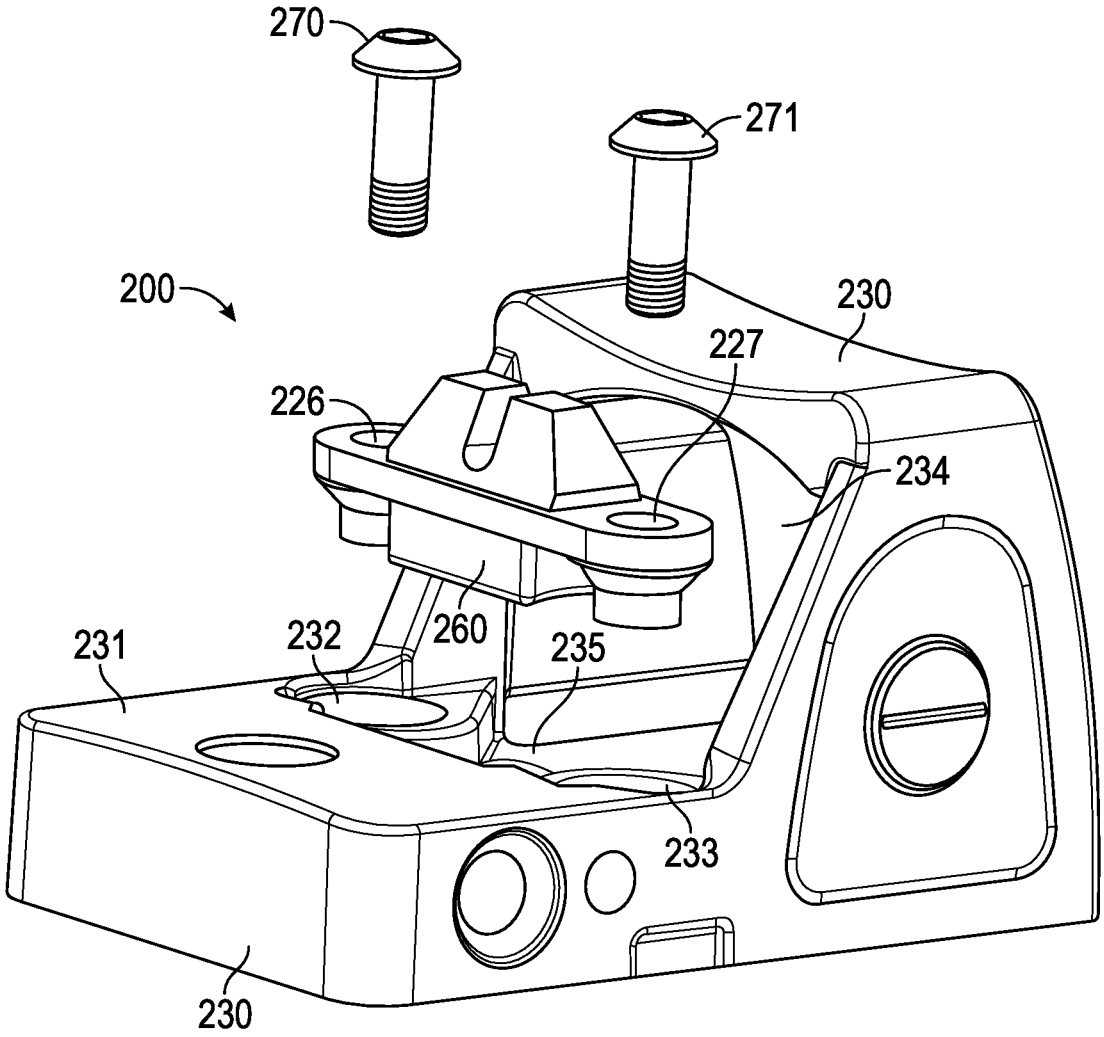
FIG. 6 shows a perspective view of an assembly of the rear sight according to the second illustrated embodiment.

FIG. 6 shows a perspective view of an assembly of the rear sight (200) according to the second illustrated embodiment. The assembly comprises the rear sight, an optic mount (230), a first fastener (270), and a second fastener (271). The optic mount comprises a first mounting hole (232) and a second mounting hole (233) on an optic body (231) thereof. The first and second mounting holes are conventionally used to mount the optic mount to a slide of a firearm. The rear sight includes a first aperture (226) and a second aperture (227) configured to align with the first mounting hole and the second mounting hole, respectively. The rear sight further comprises a support component (260) configured to fit within a cut-out feature (235) of the optic body. The first fastener is configured to extend through the first aperture and couple to the first mounting hole. The second fastener is configured to extend through the second aperture and couple to the second mounting hole.

Figure 7:
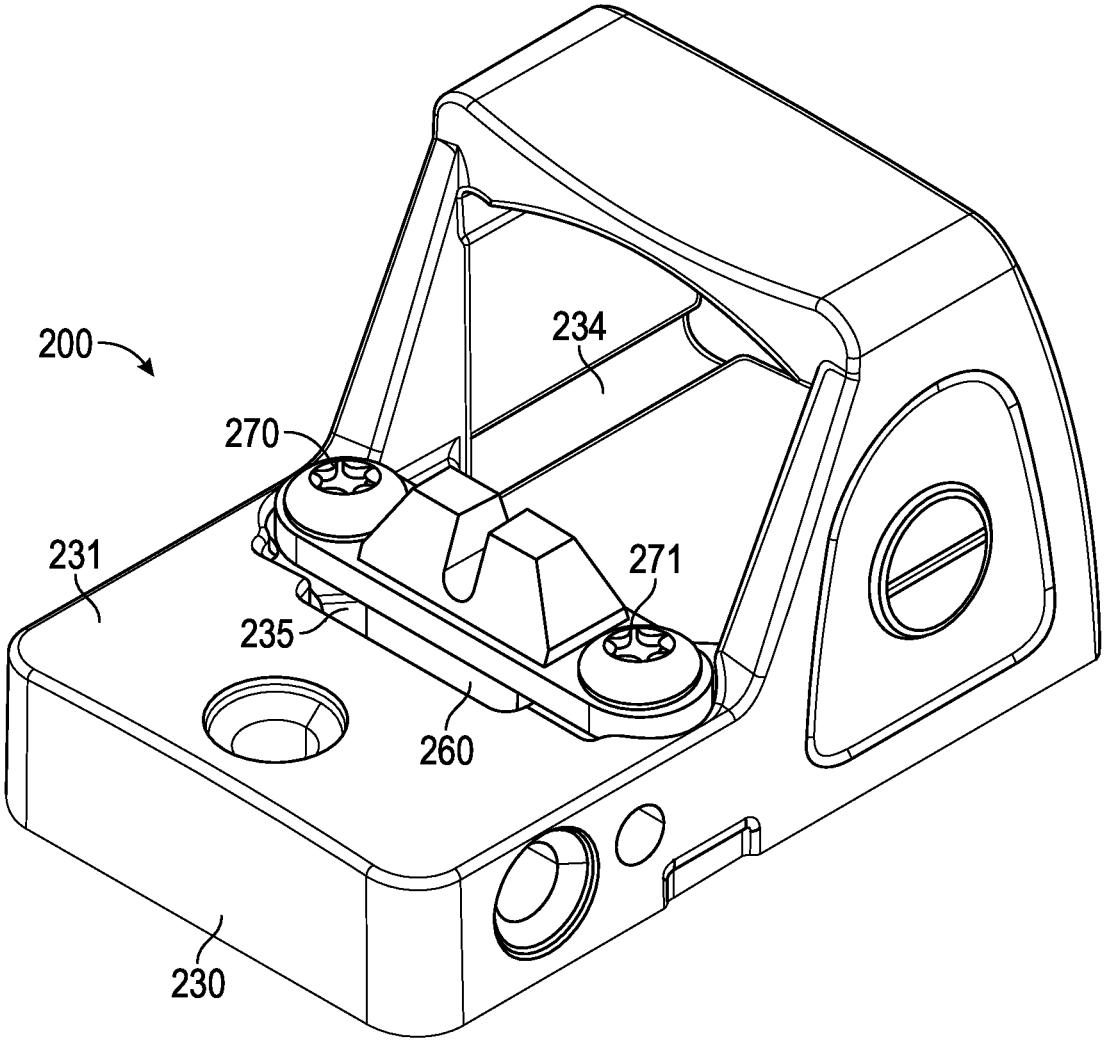
FIG. 7 shows an alternate perspective view of the assembly of the rear sight according to the second illustrated embodiment.

FIG. 7 shows an alternate perspective view of the assembly of the rear sight (200) according to the second illustrated embodiment. The rear sight is aligned and coupled to an optic mount (230) via a first fastener (270) and a second fastener (271). An optic body (231) of the optic mount includes a cut-out feature (235) with a support component (260) of the rear sight disposed therein. The rear sight is disposed behind an optic sight (234) of the optic mount such that the rear sight is positioned between the optic sight and a user of an associated firearm.

Figure 8:
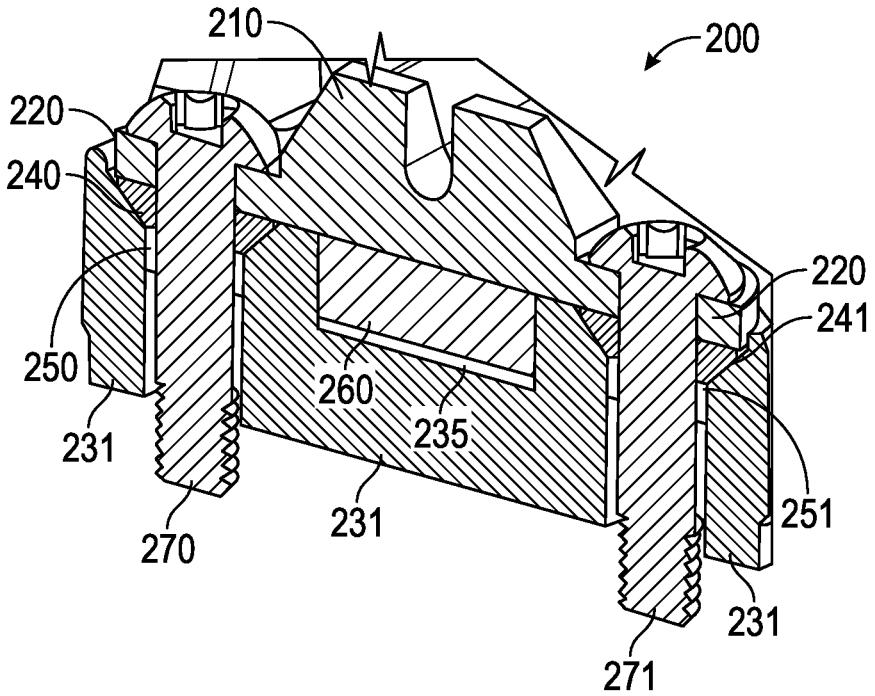
FIG. 8 shows a cross-section view of the assembly of the rear sight according to the second illustrated embodiment.

FIG. 8 shows a cross-section view of the assembly of the rear sight (200) according to the second illustrated embodiment. The rear sight comprises a notch component (210) coupled to a base portion (220). A first countersunk extension (240) is coupled to a bottom surface (223) of the base portion. A first post element (250) is coupled to first countersunk extension. A first fastener (270) extends through each of a first aperture of the base portion, an opening of the first countersunk extension, and an opening of the first post element. Remaining portion of the first fastener is then configured to couple to a first mounting hole of an optic mount.

Additionally, a second countersunk extension (241) is coupled to the bottom surface (223) of the base portion (220). A second post element (251) is coupled to the second countersunk extension. A second fastener (271) extends through each of a second aperture of the base portion, an opening of the second countersunk extension, and an opening of the second post element. Remaining portions of the second fastener is then configured to couple to a second mounting hole of the optic mount.

Third Illustrated Embodiment

Figure 9:
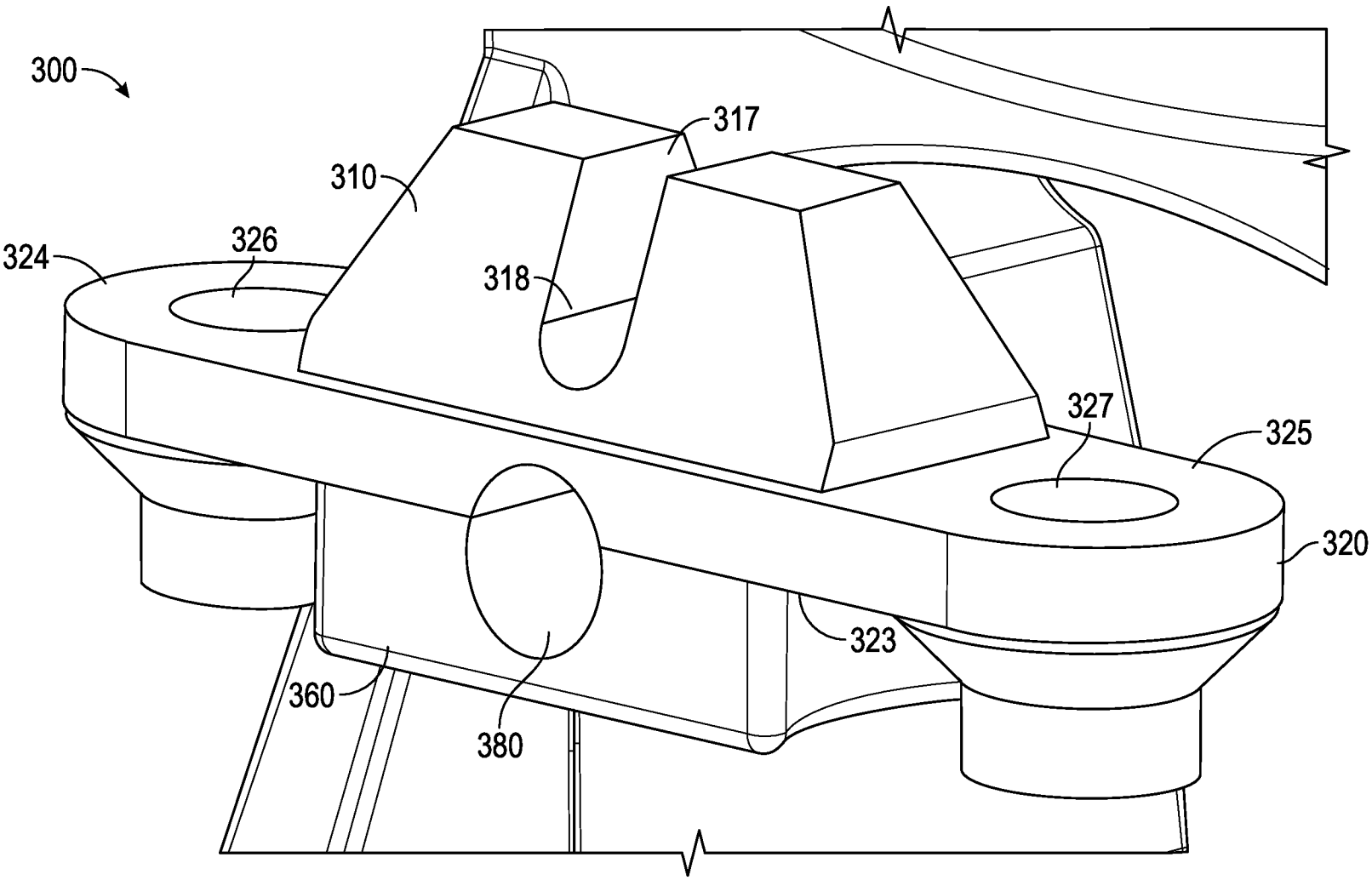
FIG. 9 shows a perspective view of the rear sight in accordance with a third illustrated embodiment.
Figure 10:
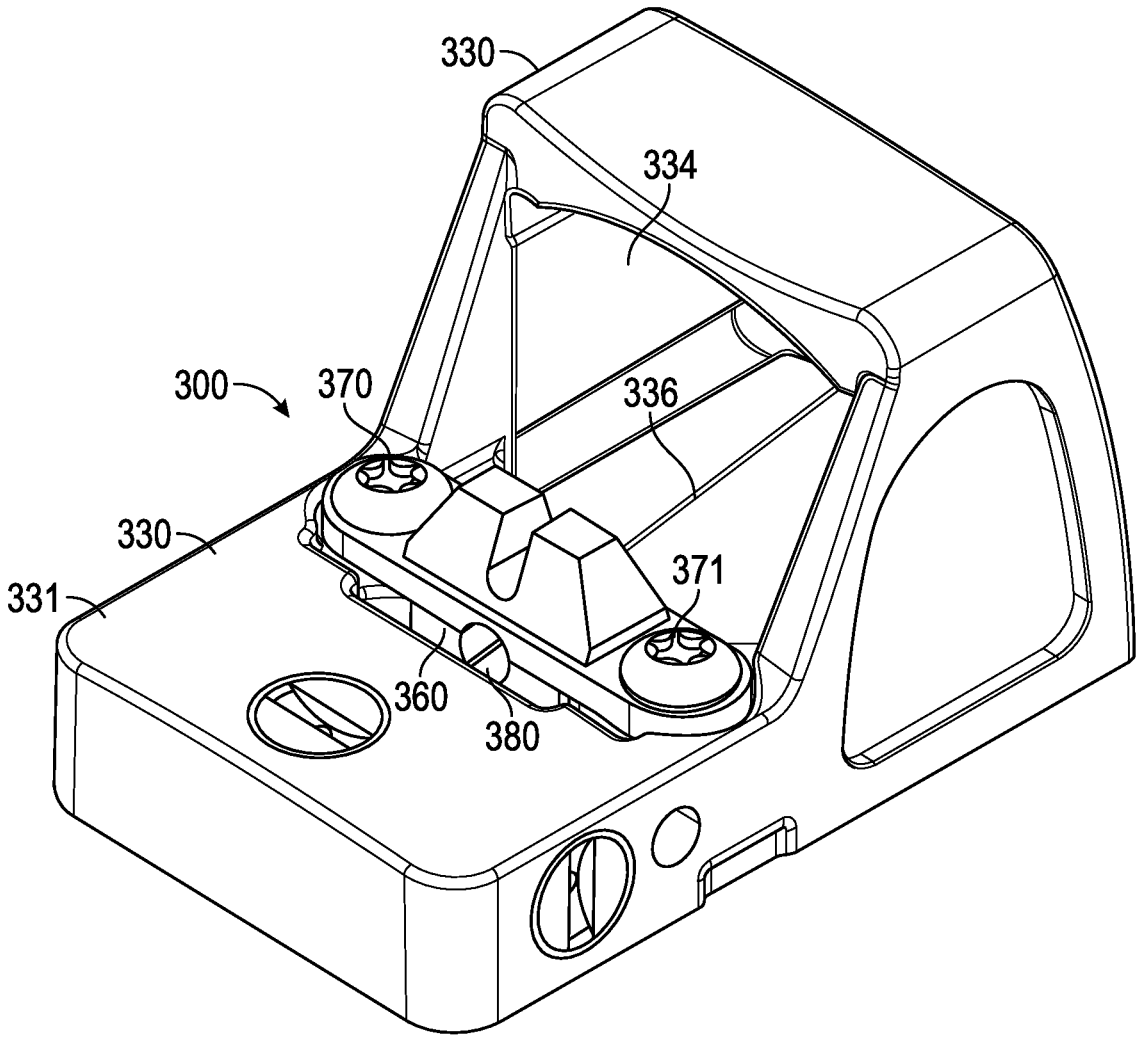
FIG. 10 shows a perspective view of the rear sight according to the third illustrated embodiment.

FIGS. 9 and 10 show the rear sight (300) in accordance with a third illustrated embodiment. The rear sight comprises a notch component (310) coupled to a base portion (320) wherein the notch component is configured as a rear sight of a firearm. The notch component comprises a notch (317) forming a channel (318) extending across the rear sight. The base portion comprises a first flange (324) having a first aperture (326) and a second flange (325) having a second aperture (327). The base portion further comprises a bottom surface (323) with a support component (360) disposed thereon. A light opening (380) extends through both the support component and the base portion. The light opening is configured to allow an optic light (336) of an optic mount (330) to pass through the rear sight without causing interference. The optic light is emitted from an optic emitter of the optic mount. The optic light is configured to form a target on an optic sight (334) which provides better aiming of a firearm. In some embodiments, the light opening extends through only the support component. In other embodiments, the light opening extends through both the support component and base portion as portion as shown. The light opening is characterized as being in parallel alignment with the channel of the notch component and is vertically aligned with said channel. Generally, a center of the channel is directly vertical to a center of the light opening

Fourth Illustrated Embodiment

Figure 11:
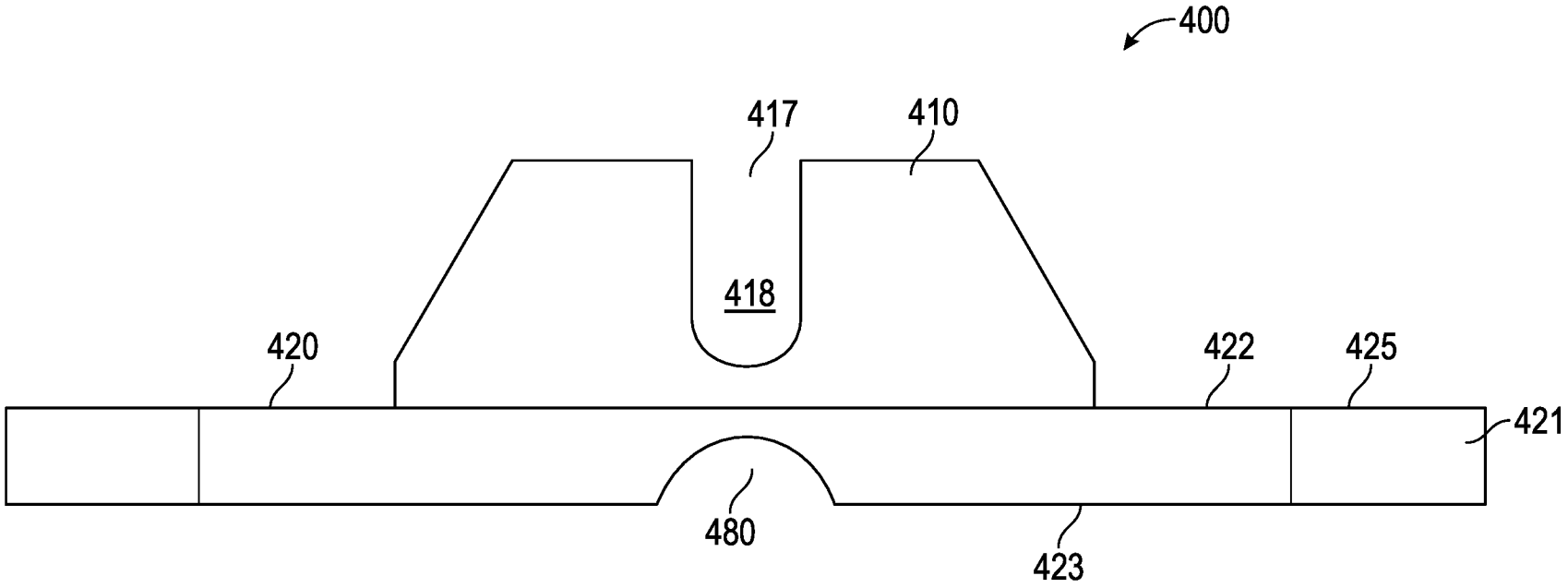
FIG. 11 shows a front view of the rear sight in accordance with a fourth illustrated embodiment.
Figure 12:
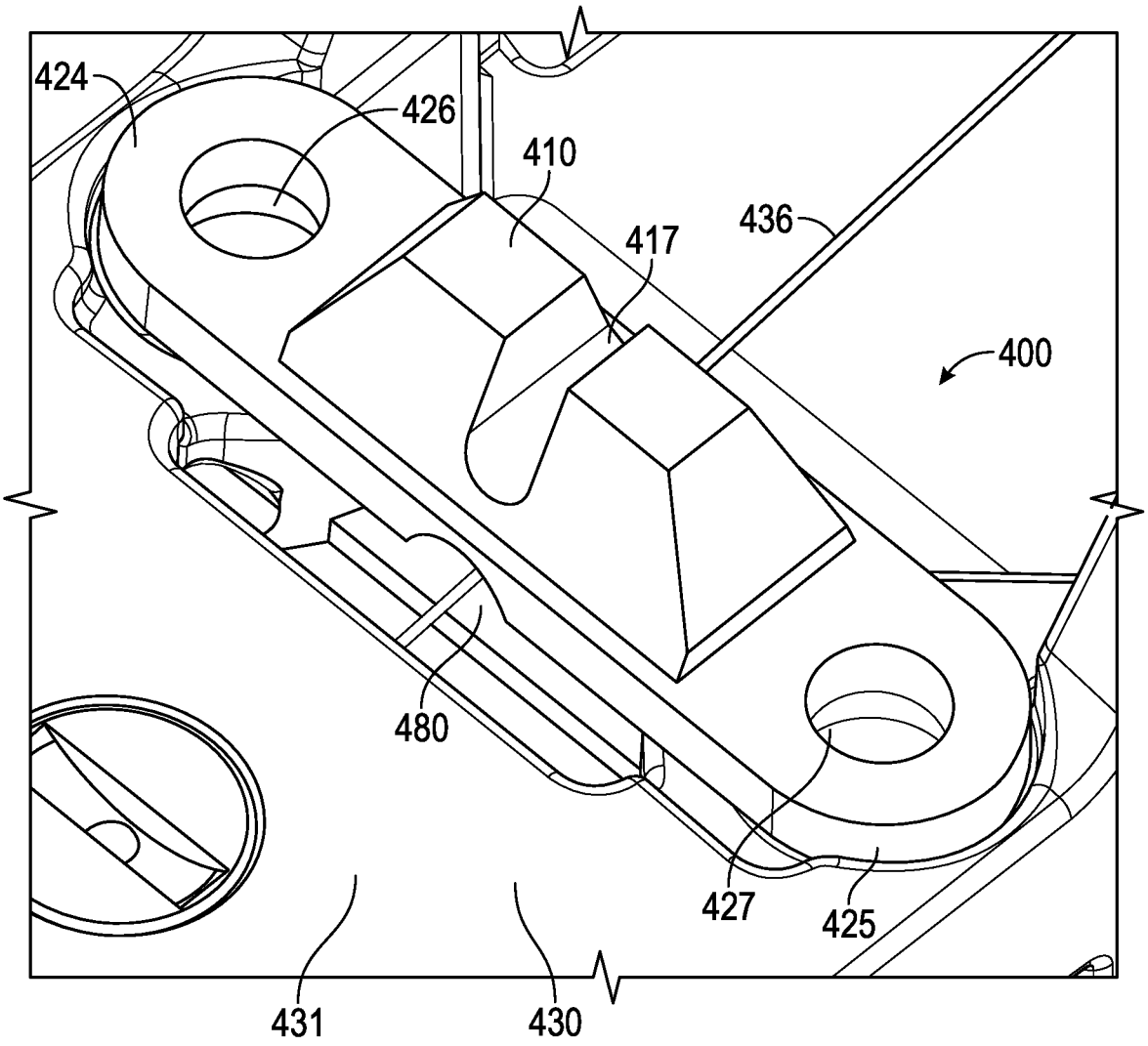
FIG. 12 shows a perspective view of the rear sight according to the fourth illustrated embodiment.

FIGS. 11 and 12 show the rear sight (400) in accordance with a fourth illustrated embodiment. The rear sight comprises a base portion (420) having a top surface (422), a bottom surface (423), and a base thickness (421) disposed therebetween. The base portion further comprises a first flange (424) and a second flange (425) wherein the first flange comprises a first aperture (426) and the second flange comprises a second aperture (427). A notch component (410) is disposed on the top surface of the base portion. The notch component includes a notch (417) forming a channel (418) down a center of the notch component. A groove (480) extends through the base portion wherein the groove is vertically aligned and parallel with the channel. The groove is disposed at a center of the base portion. The groove is disposed vertically below the channel and is configured to allow an optic light (436) emitted from an optic mount (430) to pass through the groove without causing obstruction. The groove bisects the base portion having the first flange and the second flange disposed on opposite sides of the groove

Fifth Illustrated Embodiment

Figure 13:
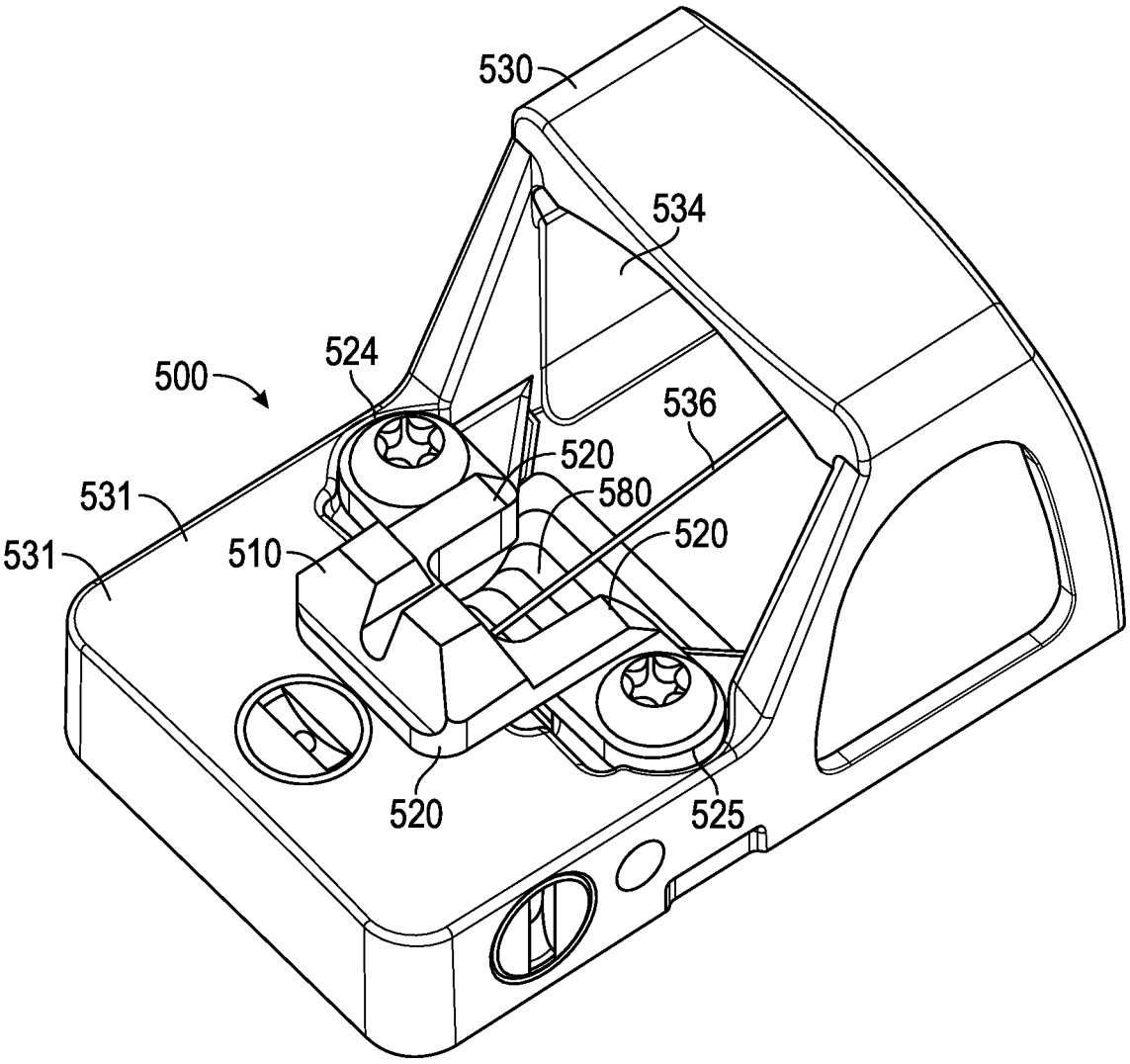
FIG. 13 shows a perspective view of the rear sight in accordance with a fifth illustrated embodiment.
Figure 14:
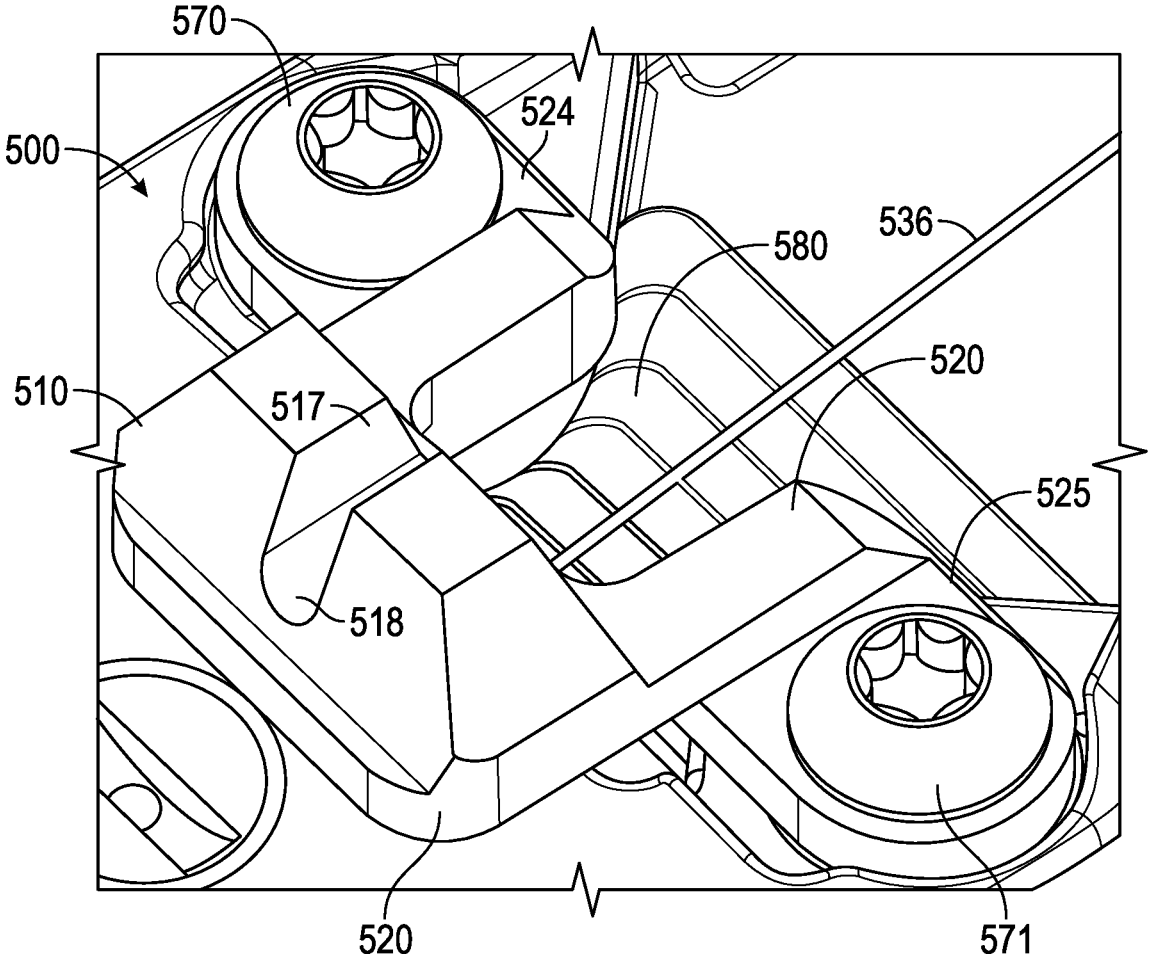
FIG. 14 shows an alternative perspective view of the rear sight according to the fifth illustrated embodiment.
Figure 15:
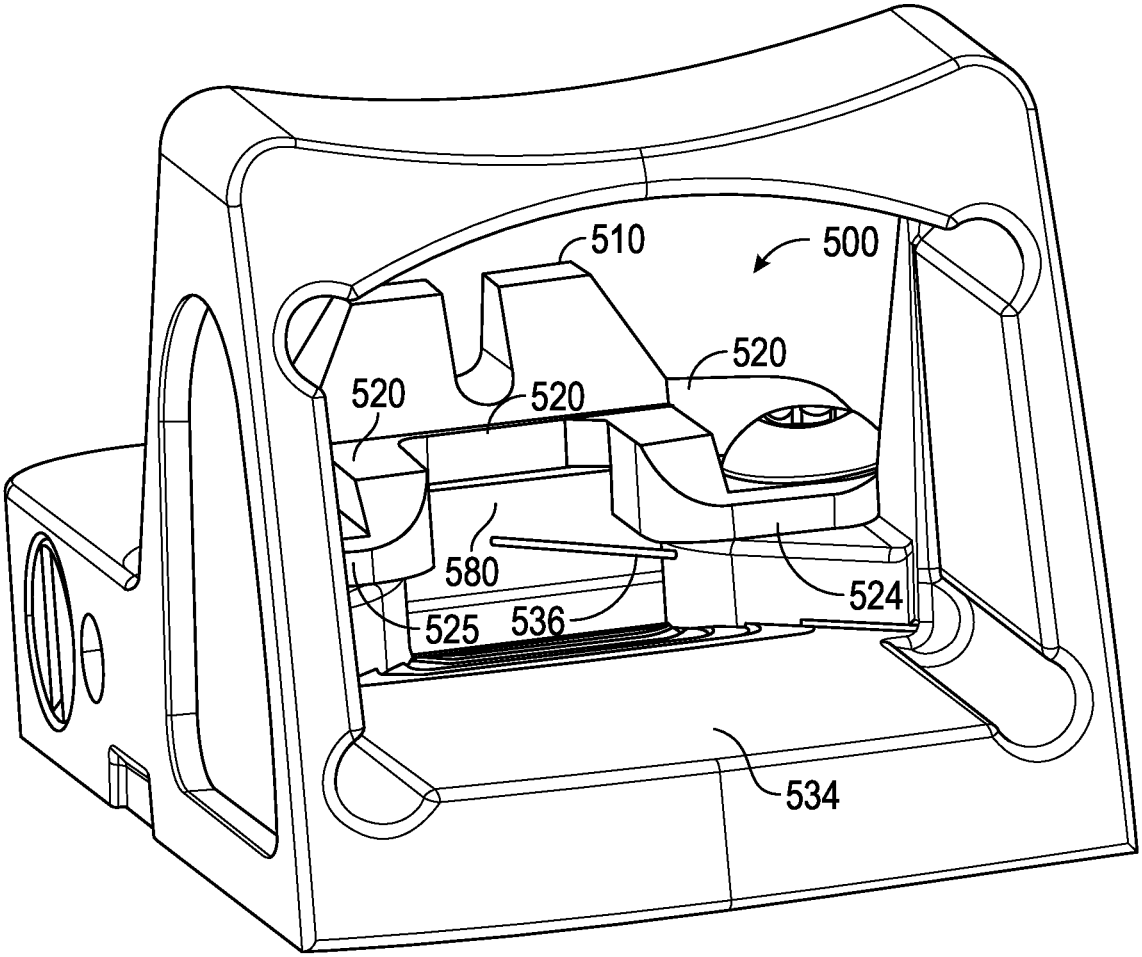
FIG. 15 shows a rear view of the rear sight according to the fifth illustrated embodiment.
Figure 16:
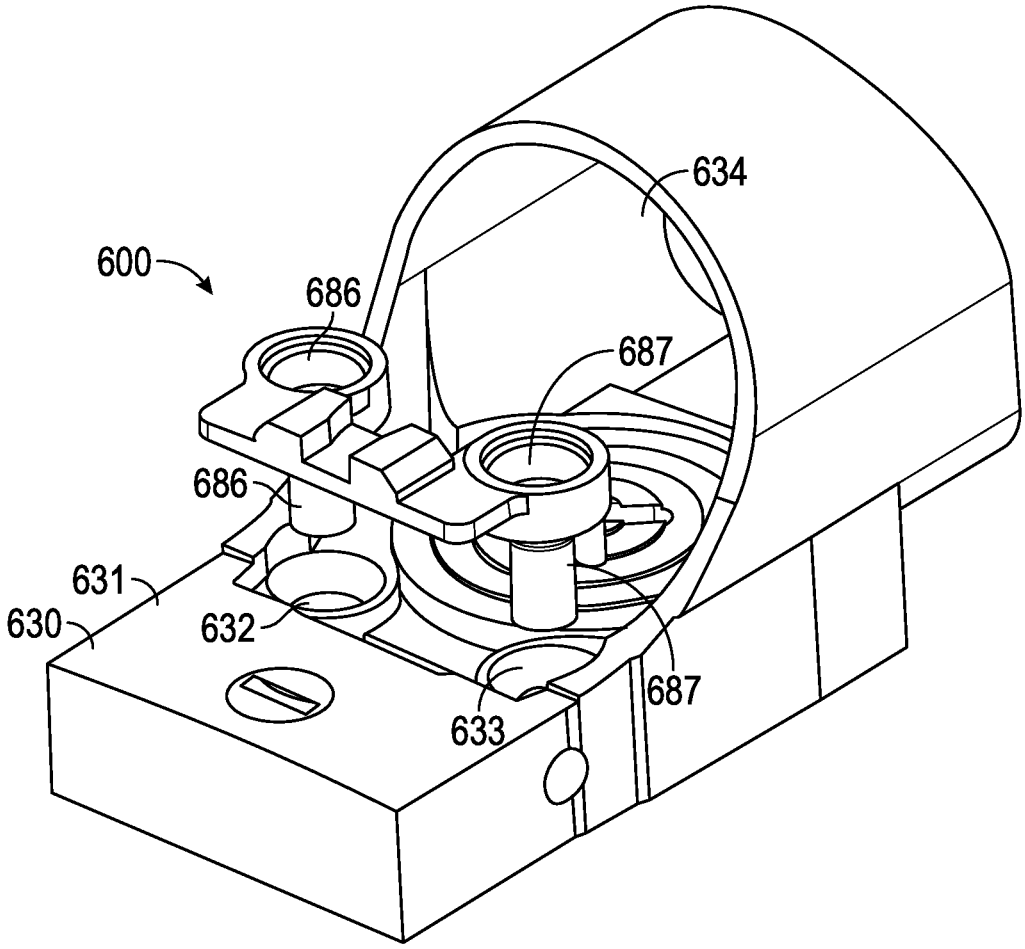
FIG. 16 shows a perspective view of the rear sight in accordance with a sixth illustrated embodiment.
Figure 17:
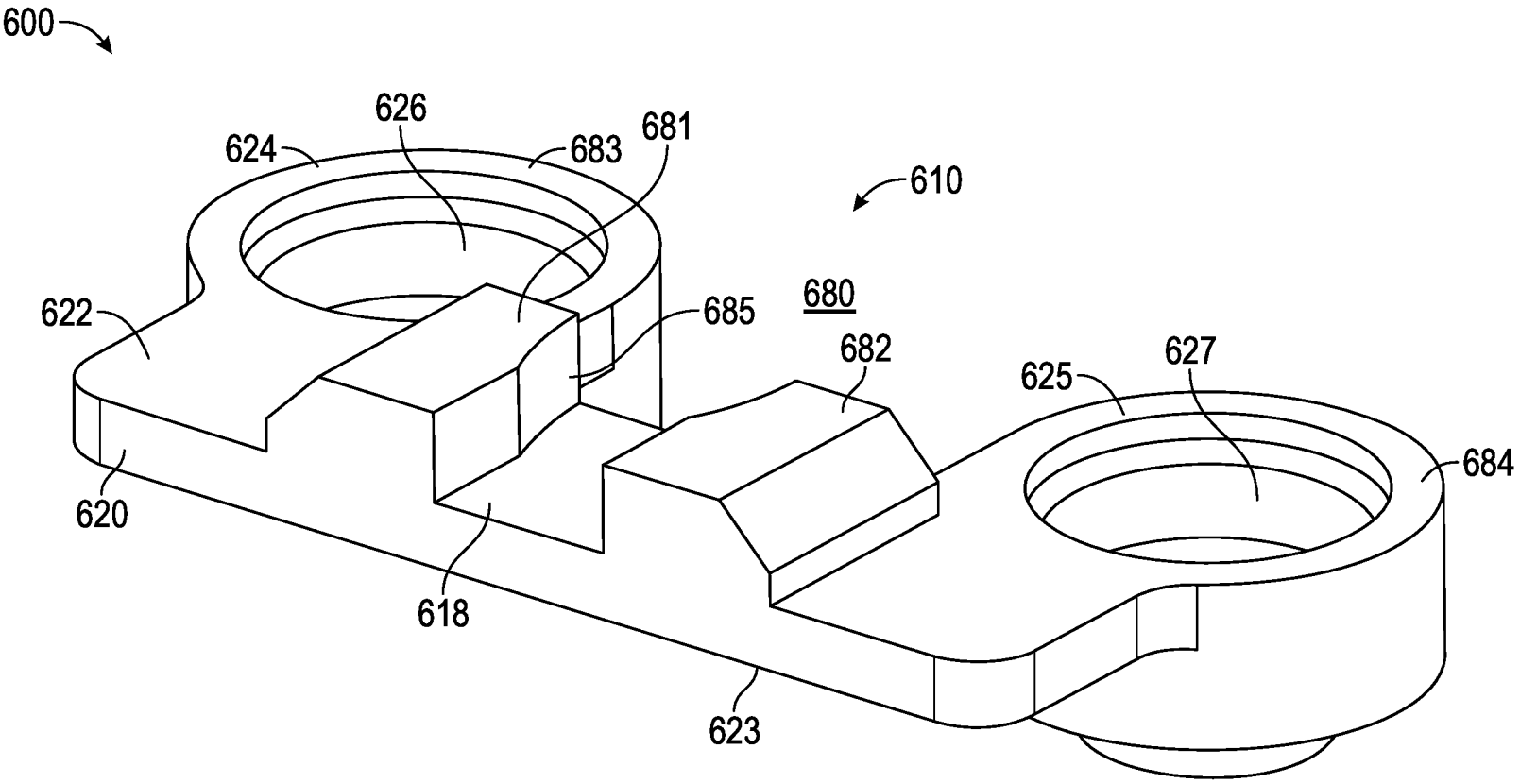
FIG. 17 shows an alternative perspective view of the rear sight according to the sixth illustrated embodiment.
Figure 18:
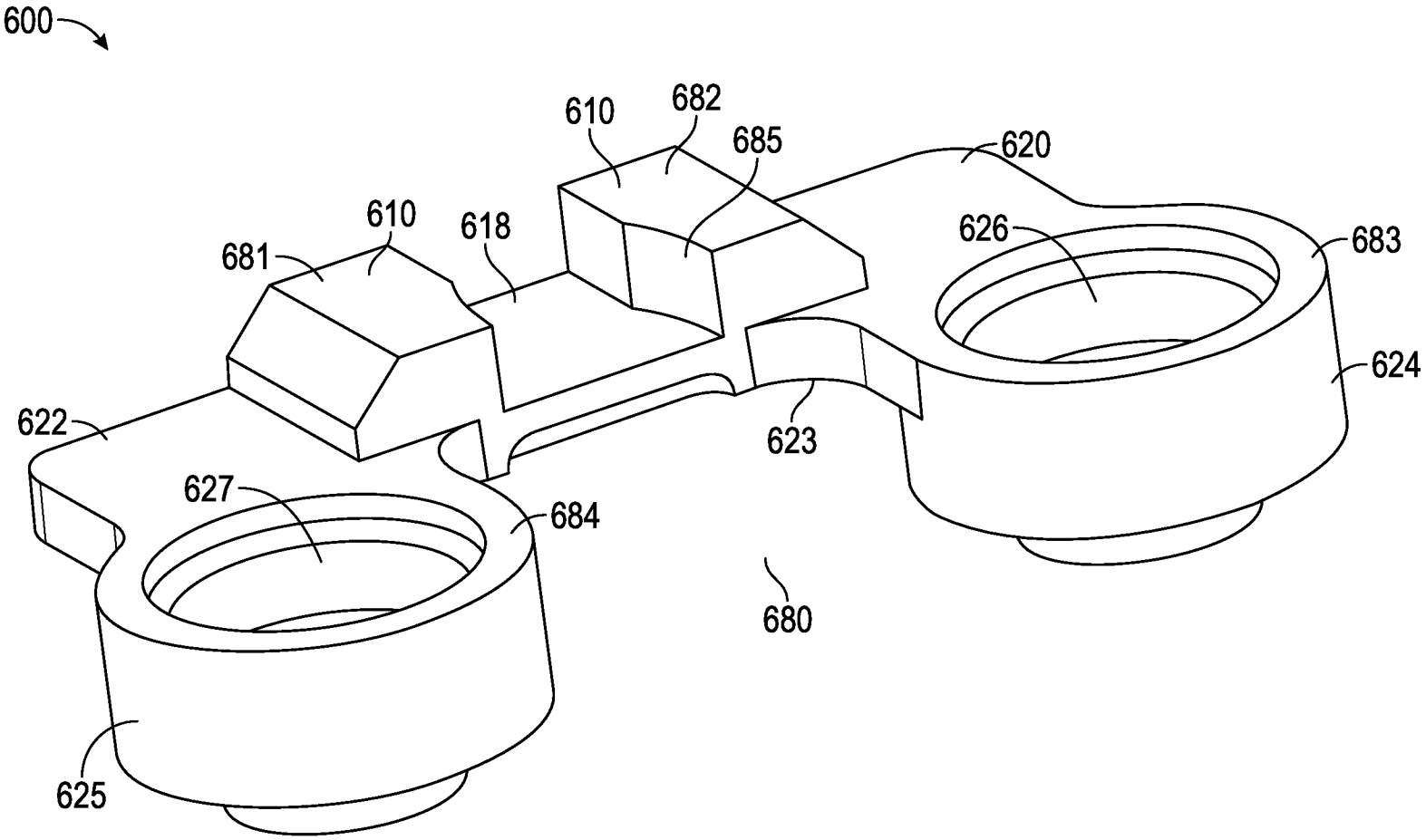
FIG. 18 shows a rear perspective view of the rear sight according to the sixth illustrated embodiment.
Figure 19:
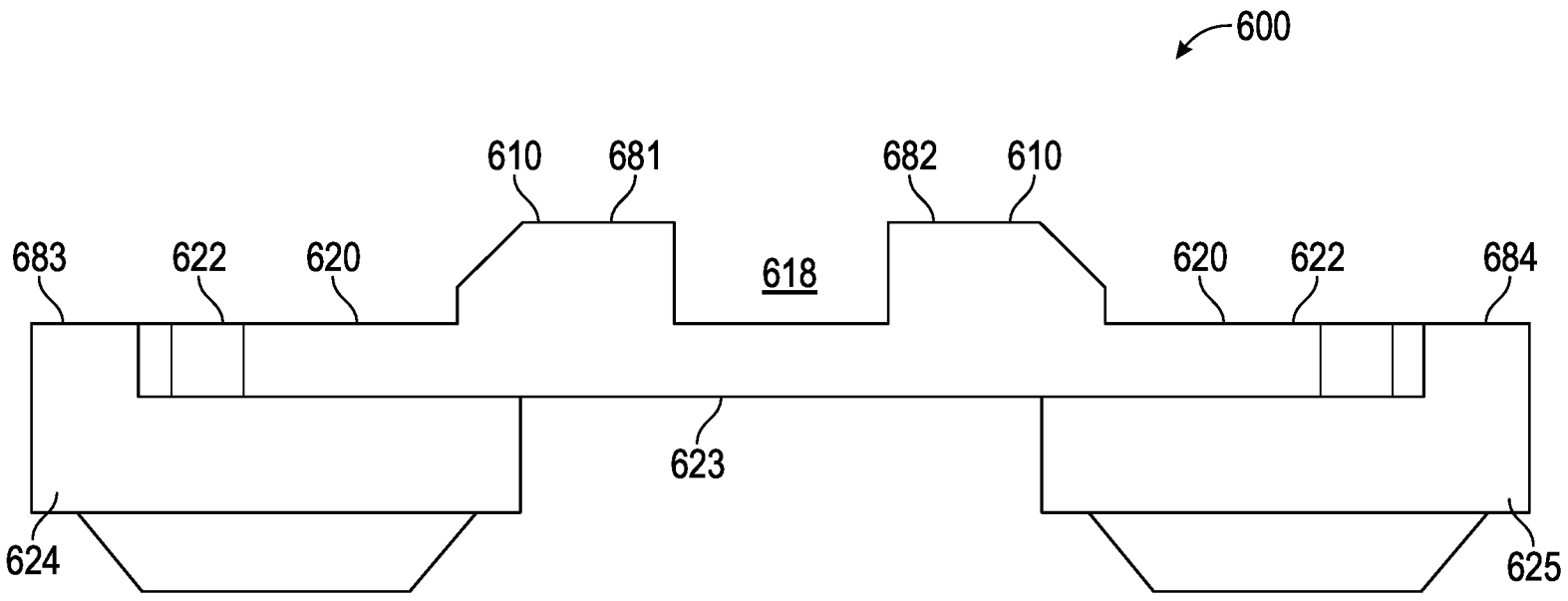
FIG. 19 shows a front view of the rear sight according to the sixth illustrated embodiment.
Figure 20:
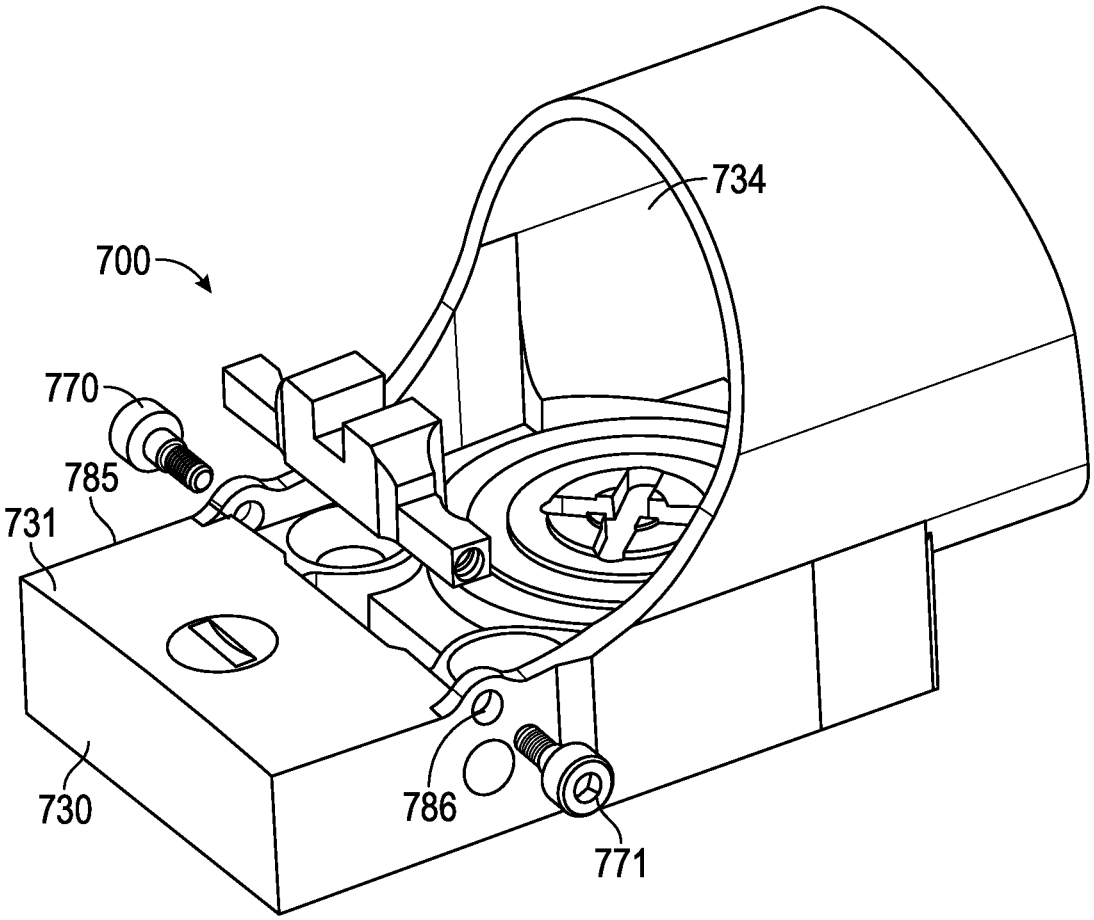
FIG. 20 shows an exploded view of the rear sight in accordance with a seventh illustrated embodiment.
Figure 21:
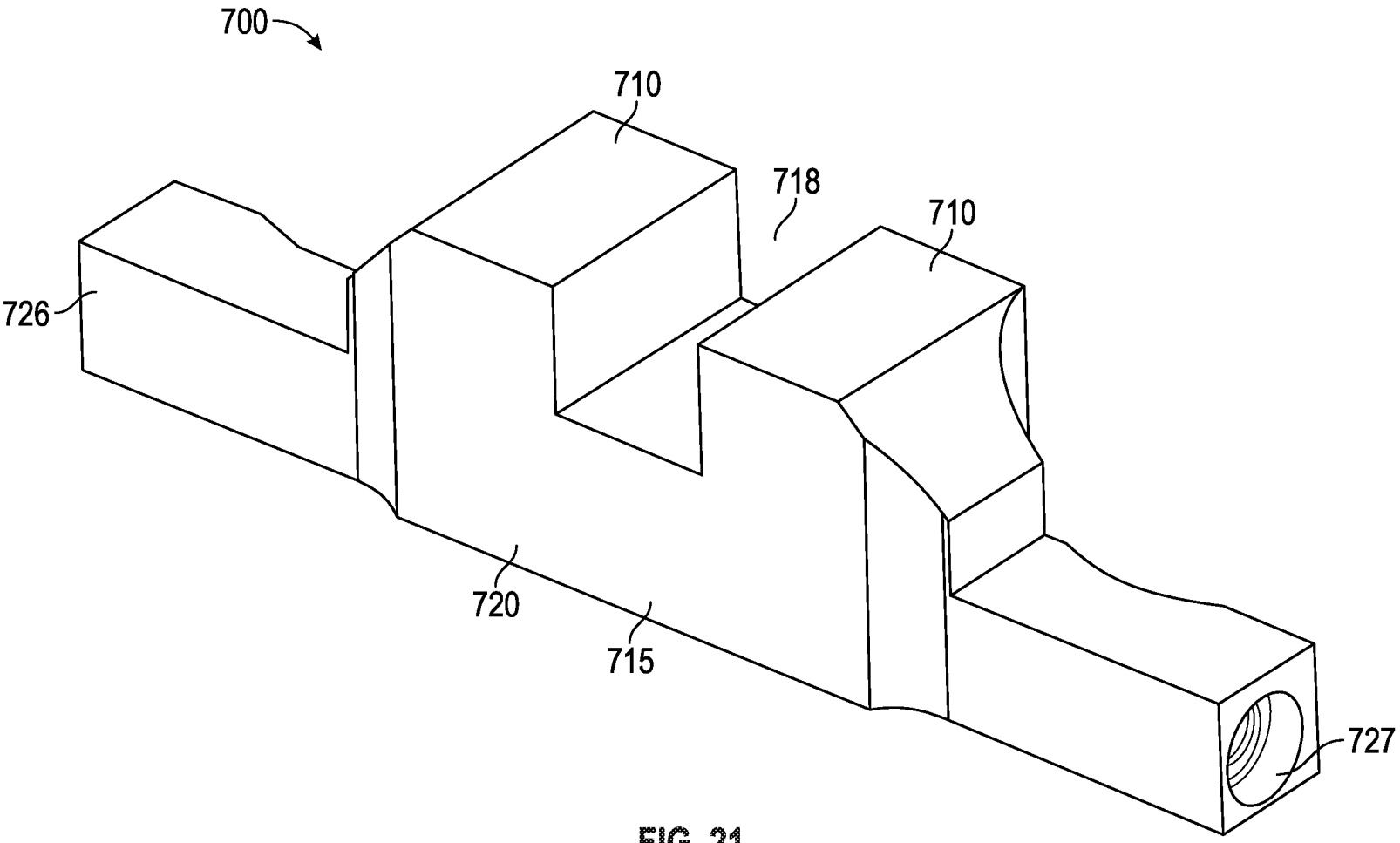
FIG. 21 shows a front perspective view of the rear sight according to the seventh illustrated embodiment.
Figure 22:
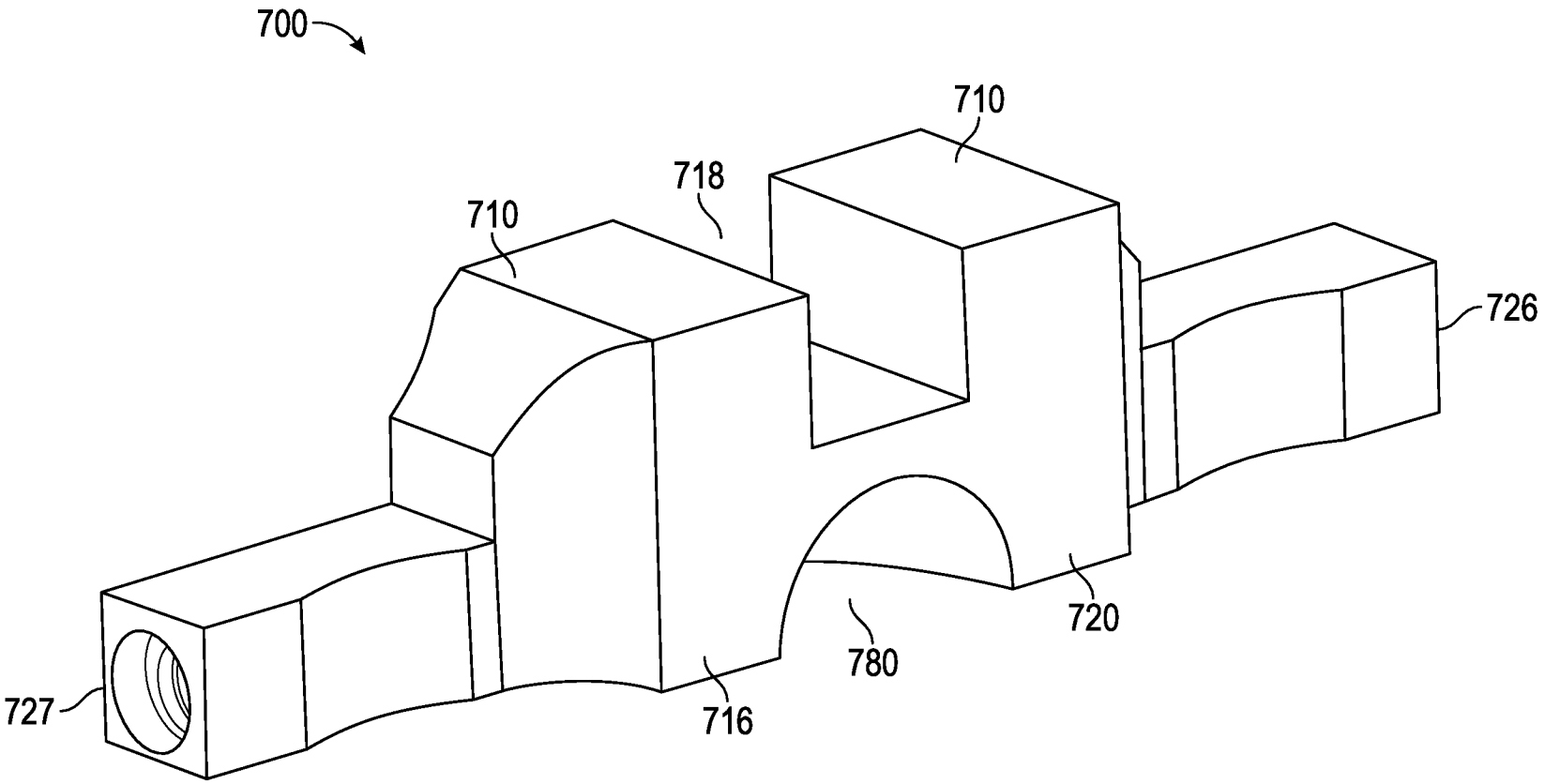
FIG. 22 shows a rear perspective view of the rear sight according to the seventh illustrated embodiment.
Figure 23:
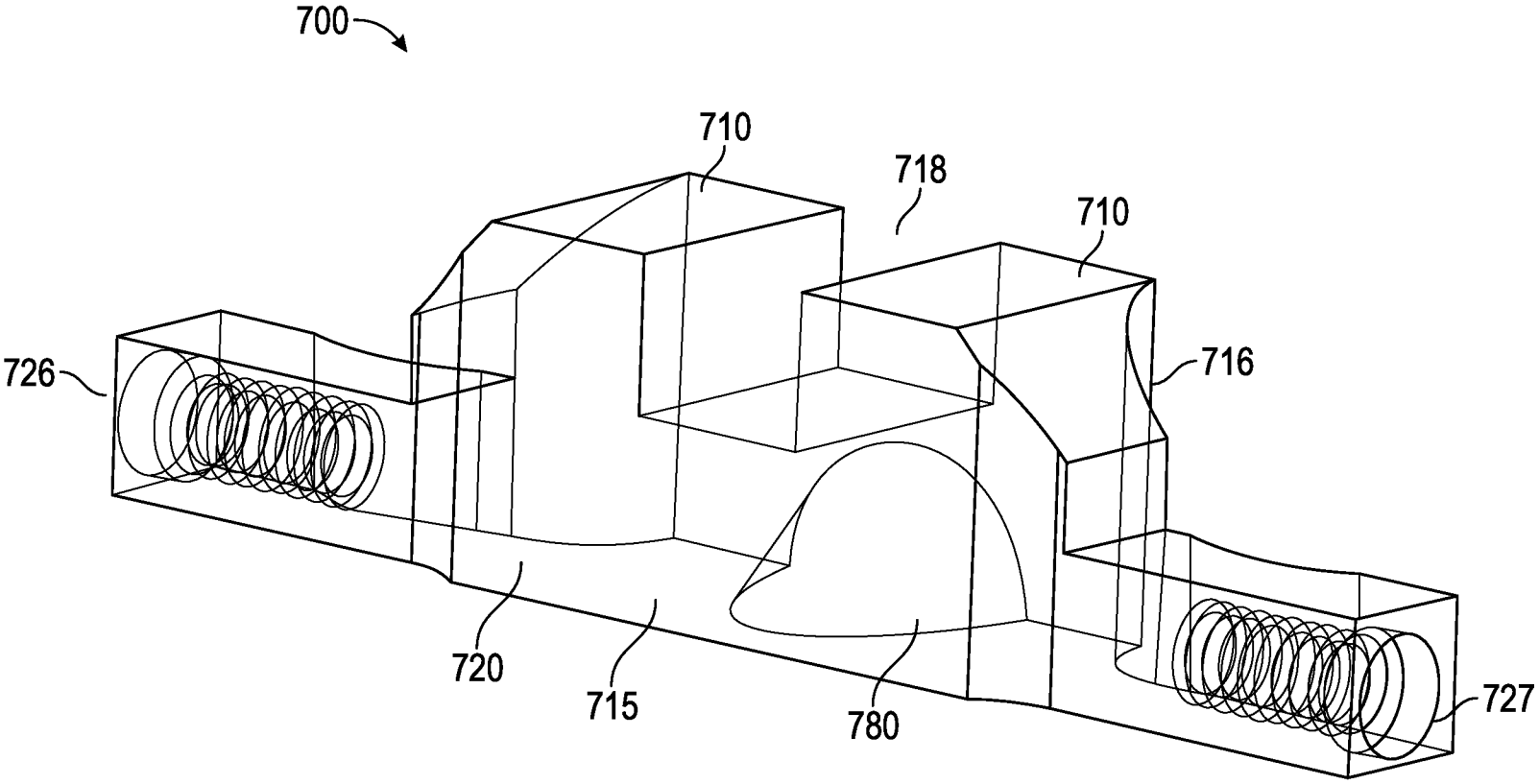
FIG. 23 shows a transparent view of the rear sight according to the seventh illustrated embodiment.

FIG. 13-15 show the rear sight (500) in accordance with a fifth illustrated embodiment. The rear sight comprises a notch component (510) disposed on top surface of a base portion (520). A first flange (524) is coupled to one end of the base portion, and a second flange (525) is coupled to another end of the base portion. The first and second flanges comprise a first and second aperture, respectively. The notch component is offset from the first flange and second flange such that a gap (580) is formed between the first and second flanges. The base portion is vertically elevated relative to the first and second flanges to allow the base portion to contact an optic body (531) of an optic mount (530). This allows the notch component to be above an optic emitter (536) of the optic mount, the optic emitter configured to emits an optic light (536) toward an optic sight (534). As shown, the first and second flanges each extend orthogonally from the base portion. In other embodiments, the first and second flanges may extend at alternative angles while ensuring a portion of the base portion comprises an elevated offset from the first and second flanges. Generally, the base portion comprises a u-shape. Other shapes may also be utilized while achieving the elevated offset of the base portion relative to the first and second flanges.

The notch component (510) on the optic body (531) and disposed above the optic emitter (536). This position of the notch components allows the user to acquire an optic dot of the optic mount much faster.

Sixth Illustrated Embodiment

FIGS. 16-19 shows a rear sight (600) in accordance with a sixth illustrated embodiment. The rear sight comprises a base portion (620) having a top surface (622) and a bottom surface (623) opposite the top surface. Coupled to the top surface is a notch component (610) having a first notch member (681) and a second notch member (682). The first and second notch members are spaced apart to form a channel (618) extending across the base portion. The channel allows a user to align the rear sight with a corresponding front sight on a firearm. The first and second notch member each comprise an optional radius (685) along a portion formed by the channel.

The base portion (620) further comprises a first flange (624) and a second flange (625). The first and second flange comprise a first aperture (626) and a second aperture (627). respectively. The first and second apertures are configured to engage with a first insert (686) and a second insert (687). The first and second apertures are further configured to receive fasteners for secure coupling of the rear sight (600) with an optic mount (630). The first and second apertures are configured to align with a first mounting hole (632) and a second mounting hole (633), respectively, of the optic mount. In some embodiments, the rear sight may comprise an over-molded polymer which couples to the first and second inserts wherein the first and second inserts comprise a metallic composition. In other embodiments, the rear sight may comprise a monolithic structure. As shown, the first and second inserts each comprise a hollow interior to allow a fastener to extend therethrough.

The notch component (610) comprises an offset relative to the first aperture (626) and second aperture (627) such that a gap (680) is formed between the first and second aperture. The offset and subsequent gap allows the notch component to avoid interference with an optic light emitted form an optic emitter of the optic mount (630). The bottom surface (623) of the base portion (620) is configured to abut an optic body (631) of the optic mount wherein the notch component is disposed above the optic emitter. The optic light from the optic emitter is configured to travel between the first insert (686) and second insert (687) in the space provided.

The first flange (624) includes a first flange surface (683) wherein the first flange surface comprises a same surface as the top surface (622) of the base portion (620). The first flange surface can be characterized as being aligned and coplanar with the top surface. Additionally, the second flange (625) includes a second flange surface (684) wherein the second flange surface comprises a same surface as the top surface of the base portion. The second flange surface can be characterized as being aligned and coplanar with the top surface. A bottom portion of each flange extends further downward than the bottom surface (623) of the base portion.

The notch component (610) on the optic body (631) and disposed above the optic emitter (not shown). This position of the notch components allows the user to acquire an optic dot of the optic mount much faster.

Seventh Illustrated Embodiment

FIGS. 20-23 show a rear sight (700) in accordance with a seventh illustrated embodiment. The rear sight comprises a notch component (710) coupled to a base portion (720). The base portion comprises a front side (715) facing towards a user of the rear sight, and a back side (716) opposite the front side and facing away from a user of the rear sight. The notch component includes a channel (718) extending across the notch component to provide a user an unobstructed sight therethrough. The base portion includes a light opening (780) to avoid interference of with a light emitting from an optic mount (730). The light opening extends from the back side into the base portion and towards the front side but terminating prior to reaching the front side, thereby forming a recess viewable only from the back side of the base portion.

Rather than sharing the same mounting holes as illustrated in previous embodiments, the rear sight (700) utilizes side mounting holes (785; 786) disposed on opposite sides of the optic mount (730). The rear sight comprises a first aperture (726) on a first flange (724) and a second aperture (727) on a second flange (725). The first and second apertures are disposed on opposite sides of the base portion (720). Each of the first and second apertures comprise an aperture direction (728) wherein the aperture direction of the first aperture is opposite the aperture direction of the second aperture. The first and second apertures are configured to align with the first and second side mounting holes and further configured to receive a first fastener (770) and a second fastener (771) respectively. Each of the first aperture and second aperture is characterized as being in an orthogonal alignment with the channel (718).

While various details, features, and combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims.

FEATURE LIST rear sight (100; 200; 300; 400; 500; 600; 700)
notched component (110; 210; 310; 410; 510; 610; 710)
top side (111; 211)
top side width (112)
bottom side (113)
bottom side width (114)
front side (115; 715)
back side (116; 716)
notch (117; 217; 317; 417; 517)
channel (118; 318; 418; 518; 618; 718)
channel direction (119)
base portion (120; 220; 320; 420; 520; 620; 720)
base thickness (121; 421)
top surface (122; 222; 422; 622)
bottom surface (123; 223; 323; 423; 623)
first flange (124; 224; 324; 424; 524; 624)
second flange (125; 225; 325; 425; 525; 625)
first aperture (126; 226; 326; 426; 626; 726)
second aperture (127; 227; 327; 427; 627; 727)
aperture direction (128; 728)
optic mount (130; 230; 330; 430; 530; 630; 730)
optic body (131; 231; 331; 431; 531; 631; 731)
first mounting hole (132; 232; 632; 732)
second mounting hole (133; 233; 633; 733)
optic sight (134; 234; 334; 534; 634; 734)
first countersunk extension (240)
second countersunk extension (241)
first post element (250)
second post element (251)
support component (260; 360)
cut-out feature (235)
first fastener (270; 370; 570; 770)
second fastener (271; 371; 571; 771)
optic light (336; 436; 536)
light opening (380; 780)
groove (480)
gap (580; 680)

optic emitter (536)
first notch member (681)
second notch member (682)
first flange surface (683)
second flange surface (684)
radius (685)
first insert (686)
second insert (687)
first side mounting hole (785)
second side mounting hole (786)

What is claimed is:

1. A rear sight for a firearm, the rear sight comprising:

a base portion having a top surface and a bottom surface opposite the top surface, the base portion further comprising a first flange and a second flange, the first flange comprises a first aperture extending downward through the base portion and the second flange comprises a second aperture extending downward through the base portion; and a notch component coupled to the base portion at the top surface, the notch component comprising a notch forming a channel, the channel having a channel direction.

2. The rear sight of claim 1, the first aperture and the second aperture each further comprising an aperture direction wherein the aperture direction of the first aperture is non-collinear with the aperture direction of the second aperture.

3. The rear sight of claim 1, further comprising an opening extending through at least a portion of the base portion, wherein the opening is disposed vertically below the notch component, the opening configured to allow a light from an optic mount to pass through.

4. The rear sight of claim 1, further comprising a first countersunk extension coupled to the bottom surface and concentrically aligned with the first aperture, and a second countersunk extension coupled to the bottom surface and concentrically aligned with the second aperture.

5. The rear sight of claim 4, further comprising a support component coupled to the bottom surface of the base portion, the support component disposed vertically below the notch component.

6. The rear sight of claim 1, the notch component further comprising an offset from the first flange and the second flange such that a gap is formed between the first flange and the second flange.

7. A rear sight assembly for a firearm, comprising an optic mount having an optic body an optic emitter disposed within the optic body, the optic emitter configured to emit a laser to an optic sight, the optic mount further comprising a first top mounting hole, a second top mounting hole, a first side mounting hole, and a second side mounting hole; and a rear sight coupled to the optic mount at the first top mounting hole and the top second mounting hole, the rear sight further comprising:

a base portion having a top surface and a bottom surface opposite the top surface, the base portion further comprising a first flange and a second flange, the first flange comprises a first aperture aligned with the first top mounting hole and the second flange comprises a second aperture aligned with the second top mounting hole, and a notch component coupled to the base portion at the top surface, the notch component comprising a notch forming a channel, the channel having a channel direction.

8. The rear sight assembly of claim 7, further comprising a first fastener configured to couple to the first aperture and the first mounting hole, and a second aperture configured to couple to the second aperture and the second mounting hole.

9. The rear sight assembly of claim 7, wherein the notch component is disposed vertically above the optic emitter.

10. The rear sight assembly of claim 7, the optic mount further comprising a cutout feature between the optic emitter and the optic sight, wherein a support component is coupled to the bottom surface of the rear sight, the support component configured to be disposed in the cutout feature for elevating the notch component.

11. The rear sight assembly of claim 7, wherein the notch component is disposed on the optic body and positioned above the optic emitter.

12. The rear sight assembly of claim 7, wherein the base portion is disposed between the optic emitter and the optic sight.

13. The rear sight of assembly of claim 7, the first aperture and the second aperture each further comprising an aperture direction wherein the aperture direction of the first aperture is non-collinear with the aperture direction of the second aperture.

14. The rear sight of claim 1, wherein the first aperture and the second aperture each extends through the top surface and the bottom surface.

15. The rear sight of claim 1, wherein first aperture and the second aperture are configured to align with a first top mounting hole and a second top mounting hole of an optic mount.

16. The rear sight of claim 1, wherein a fastener is configured to engage with the top surface of the base portion.

17. The rear sight assembly of claim 7, wherein the first aperture extends downward through the base portion and the second aperture extends downward through the base portion.

18. The rear sight assembly of claim 7, wherein the first aperture and the second aperture each extends through the top surface and the bottom surface.

19. The rear sight assembly of claim 7, wherein a fastener is configured to engage with the top surface of the base portion.

20. The rear sight assembly of claim 7, further comprising a first countersunk extension coupled to the bottom surface and concentrically aligned with the first aperture, and a second countersunk extension coupled to the bottom surface and concentrically aligned with the second aperture.

* * * * *